US010060076B2

(12) United States Patent
Uymur et al.

(10) Patent No.: US 10,060,076 B2
(45) **Date of Patent: *Aug. 28, 2018**

(54) PAPER MACHINE SCREEN

(71) Applicant: ANDRITZ TECHNOLOGY AND ASSET MANAGEMENT GMBH, Graz (AT)

(72) Inventors: Ipek Uymur, Moenchengladbach (DE); Wolfgang Heger, Nideggen (DE)

(73) Assignee: Andritz Technology & Asset Management GmbH, Graz (AT)

( * ) Notice: Subject to any disclaimer, the term of this patent is extended or adjusted under 35 U.S.C. 154(b) by 68 days.

This patent is subject to a terminal disclaimer.

(21) Appl. No.: 15/331,662

(22) Filed: Oct. 21, 2016

(65) Prior Publication Data

US 2017/0037572 A1 Feb. 9, 2017

(30) Foreign Application Priority Data

Jun. 18, 2013 (DE) ..... 10 2013 106 327

(51) Int. Cl.
*D21F 1/00* (2006.01)
*D21F 1/10* (2006.01)
(Continued)

(52) U.S. Cl.
CPC ..... *D21F 1/80* (2013.01); *D03D 11/00* (2013.01); *D21F 1/0036* (2013.01); *D21F 1/0045* (2013.01)

(58) Field of Classification Search
CPC .... D21F 1/0027; D21F 1/0036; D21F 1/0045; D21F 1/0054; D21F 1/10; D21F 1/12;
(Continued)

(56) References Cited

U.S. PATENT DOCUMENTS 4,569,375 A 2/1986 Borel
4,974,642 A 12/1990 Taipale
(Continued)

FOREIGN PATENT DOCUMENTS

CA 1115177 12/1981
CN 102197176 9/2011
(Continued)

OTHER PUBLICATIONS

Notice of Allowance and English translation issued in corresponding application KR 10-2015-7020838 dated May 26, 2016.
(Continued)

*Primary Examiner* — Eric Hug
(74) *Attorney, Agent, or Firm* — Alexander R. Schlee; Schlee IP International P.C.

(57) ABSTRACT

A paper machine screen which is formed as a transverse thread-bound, multi-layer fabric. Binding transverse threads extend respectively both in an upper fabric layer and in a lower fabric layer and hereby bind the lower fabric layer to the upper fabric layer. The binding transverse threads form functional transverse thread pairs within the total repeat, the transverse threads of which alternately complete the first weave. In the total repeat, the functional transverse thread pairs in the upper fabric layer are arranged in groups of respectively two or more functional transverse thread pairs arranged directly one after another, when seen in a longitudinal direction.

17 Claims, 12 Drawing Sheets

(51) Int. Cl.
*D21F 1/80* (2006.01)
*D03D 11/00* (2006.01)

(58) Field of Classification Search
CPC ... D21F 1/105; D21F 1/80; D21F 7/08; D21F 7/10; D21F 7/12; D21F 7/083; D03D 3/04; D03D 11/00; D03D 13/00; D03D 13/004; D03D 13/008
USPC ..... 162/348, 358.2, 900, 902–904; 139/383 A, 383 AA, 425 A
See application file for complete search history.

(56) References Cited

U.S. PATENT DOCUMENTS

| | | | |
|---|---|---|---|
| 5,826,627 | A | 10/1998 | Seabrook et al. |
| 6,223,780 | B1 | 5/2001 | Kaldenhoff |
| 6,354,335 | B1 | 3/2002 | Taipale et al. |
| 6,904,942 | B2 | 6/2005 | Odenthal |
| 7,487,805 | B2 | 2/2009 | Barratte et al. |
| 9,528,223 | B2 * | 12/2016 | Uymur ..... D21F 1/0045 |
| 2003/0178087 | A1 | 9/2003 | Odental |
| 2006/0116042 | A1 | 6/2006 | Nagura et al. |
| 2009/0139679 | A1 | 6/2009 | Howarth et al. |
| 2009/0205740 | A1 | 8/2009 | Quigley |
| 2010/0236741 | A1 | 9/2010 | Hack-Ueberall et al. |
| 2010/0236742 | A1 | 9/2010 | Rigby et al. |
| 2010/0317555 | A1 | 12/2010 | Araki et al. |

FOREIGN PATENT DOCUMENTS

| | | |
|---|---|---|
| DE | 29 17 694 | 12/1979 |
| DE | 3928484 | 6/1990 |
| DE | 4229828 | 3/1994 |
| DE | 602 12 077 | 11/2006 |
| EP | 0069101 | 1/1983 |
| EP | 0093096 | 11/1983 |
| EP | 0097966 | 1/1984 |
| EP | 0136284 | 4/1985 |
| EP | 0794283 | 9/1997 |
| EP | 1002892 | 12/2001 |
| EP | 1021616 | 5/2002 |
| EP | 1000197 | 6/2002 |
| EP | 1158090 | 8/2003 |
| EP | 1311723 | 5/2004 |
| EP | 1158089 | 8/2004 |
| EP | 0794283 | 6/2005 |
| EP | 1754820 | 2/2007 |
| EP | 2205791 | 2/2011 |
| EP | 1849912 | 10/2011 |
| GB | 2 022 638 | 12/1979 |
| JP | 200825060 | 2/2008 |
| JP | 2006152498 | 6/2008 |
| KR | 1020090058463 | 6/2009 |
| KR | 20100105394 | 9/2010 |
| WO | 93/00472 | 1/1993 |
| WO | 99/06630 | 2/1999 |
| WO | 99/06632 | 2/1999 |
| WO | 02/14601 | 2/2002 |
| WO | 2004079089 | 9/2004 |
| WO | 2004111333 | 12/2004 |
| WO | 2005014926 | 2/2005 |
| WO | 2010041123 | 4/2010 |

OTHER PUBLICATIONS

Decision to Grant a Patent and English translation issued in corresponding application JP 2015-553136.
International Search Report for underlying PCT/EP2014/059358 dated Jun. 6, 2014.
Written Opinion for underlying PCT/EP2014/059358 dated Jun. 6, 2014.
English Translation of the Written Opinion for underlying PCT/EP2014/059358 dated Jun. 6, 2014.
Non-Final Office Action dated May 24, 2016 issued in U.S. Appl. No. 14/758,207.
Reply dated Aug. 3, 2016 to Non-Final Office Action issued in U.S. Appl. No. 14/758,207.
Notice of Allowance dated Aug. 18, 2016 issued in U.S. Appl. No. 14/758,207.

* cited by examiner

PAPER MACHINE SCREEN

CROSS REFERENCE TO RELATED APPLICATION

This application is a Continuation application claiming the benefit if U.S. non-provisional patent application Ser. No. 14/758,207 filed Jun. 26, 2015 which is the national phase of the International Application PCT/EP2014/059358 filed May 7, 2014, claiming priority of the German Patent Application DE 10 2013 106 327.6 filed Jun. 18, 2013. The content of this aforementioned document is herewith incorporated by reference.

BACKGROUND OF THE INVENTION

The present invention relates to a multi-layer paper machine screen, for example to a sheet forming screen of a paper machine, especially to a sheet forming screen as it is used in the process of papermaking in the sheet forming section of a wet end of a paper machine for draining/filtration of a fiber suspension and of a paper fibrous material, respectively. Screens of this type are mainly used for high-quality graphic types of paper and packaging papers having a low paper weight/grammage and high requirements concerning printability. These papers can be produced with so-called gap formers at speeds of more than 2,000 m/min. In this respect, high demands are made on the screen's mechanical stability, draining performance, fiber support, reduced tendency to marking and lifespan.

An essential process in papermaking is the forming of the sheet (=sheet forming) which is effected by draining/dewatering a fiber suspension or paper fibrous material by means of filtration in the sheet forming section of the wet end of a paper machine by using a so-called sheet forming screen.

The fiber suspension may be understood as a mixture of mechanical pulp fibers or chemical pulp fibers, fillers and auxiliary chemical agents suspended in water.

In order to be able to produce a paper sheet as uniform as possible, it is necessary to increase or set the amount of water within the fiber suspension immediately before the sheet formation to approximately 99%. This ensures that the fibers can be distributed uniformly in the water, which is beneficial to the quality of the sheet to be formed.

The amount of water is reduced to approximately 80% by the above-mentioned filtration process within the sheet forming section, i.e. during the sheet forming process. The paper fibers and the fillers and auxiliary agents remain on the paper machine screen in a uniformly distributed manner in the form of a nonwoven fabric.

While in the past the draining process took place mainly by means of a paper machine screen applied to a Fourdrinier paper machine/long screen machine, mainly twin screening machines are being used these days, for example in the form of so-called gap formers. These twin screening machines are characterized in that the fiber suspension is injected into a gap which is formed between two paper machine screens, so that draining can take place simultaneously through both screens, whereby it is possible to significantly accelerate the filtration process and thus also the production rate of the papermaking machine. There are papermaking machines these days for types of paper having a low grammage, which are capable of producing with speeds of more than 2,000 m/min.

The extreme requirements for the paper to be produced and the conditions existing in the papermaking machine require specifically designed sheet forming screens which offer/comprise high fiber support, high openness and a high mechanical stability at the same time. In addition, a low tendency to marking of the fabric is necessary in particular for the domain of graphic papers.

Multi-layer paper machine screens have proven of value for these fields of application over the past years, comprising two sides formed in a different manner, which are adapted to the respective purpose of use. Screens of this type have a paper side which is formed by the upper side of an upper fabric. In habitual language use, the paper side is also referred to as the upper side of the screen, and is relevant for forming the paper sheet. In addition, these screens have a machine side which is formed by the lower side of a lower fabric. The machine side which can also be referred to as the lower side of the screen contacts the members of the papermaking machine. The respective screen side has a machine direction (generally the longitudinal direction) and a cross direction; in this respect, machine direction (also MD for "machine direction") refers to the running direction of the paper web and therefore also to the running direction of the paper machine screen, and the cross direction (also CMD for "cross machine direction"), sometimes also referred to as cross machine direction, is the direction turned by 90° in the plane of the paper machine screen, i.e. the direction located transverse to the running direction of the paper and the screen.

Due to the very specific configuration of modern paper machine screens, usually neither the paper and machine side nor the longitudinal/machine and cross direction are interchangeable, as otherwise the mode of operation of the screen would not be ensured or would not be ensured sufficiently. For example, the machine direction threads (=longitudinal threads) on the machine side which realize circulation of the screen, can be protected against wear by transverse threads projecting or protruding significantly. For example, providing a balanced ratio of longitudinal and transverse threads on the paper side can ensure a good depositing possibility for the paper fibers. With respect to the fiber support, but also with respect to the tendency to marking of the screen, the most simple and at the same time the oldest basic weave of textile engineering has proven of value for the upper fabric and thus for the paper side, namely the so-called plain weave. In this kind of weave, the repeat (=the smallest repeating unit of the weave) of which is formed exactly by two warp threads (as a general rule, the longitudinal threads/machine direction threads of the screen are formed by the warp threads) and two weft threads (as a general rule, the transverse threads of the screen are formed by the weft threads), the threads are connected to a fabric in a particularly close and uniform manner. Although the plain weave is very well suited for forming a paper sheet and is hence very well suited for the paper side, it is usually not suited very well for the machine side. If a paper machine screen is provided with a plain weave paper side, it can therefore be advisable to provide for a second fiber layer underneath the plain weave, forming the machine side of the screen, which gives the screen sufficient stability and wearing potential.

In this respect, the connection of the two layers (i.e. of the upper fabric forming the paper side and the lower fabric forming the machine side) is a particular challenge, amongst others due to the fact that the plain weave favorable for the paper side involves particularly unfavorable preconditions for such a layer connection.

The state of the art describes different approaches for connecting two screen fabric layers, one approach of which describes the use of additional, separate binder threads (not forming part of/not fitting into the structure and the weave pattern, respectively) extending in a longitudinal direction and/or a transverse direction. According to this approach, two finished and completed fabric layers are connected to each other by separate/additional binder threads, which binder threads do not contribute to/are not required for forming the respective fabric layer weave. Both fabric layers consist of longitudinal threads and transverse threads which extend exclusively in the respective fabric layer and thereby completely generate the respective fabric layer pattern or fabric layer weave. This approach is, for example, described in CA 1 115 177 A1, where separate binder weft threads are used which bind with warp threads of the upper fabric and warp threads of the lower fabric, and in DE 39 28 484 A1 in which separate warp threads are used as binder threads. Other examples can be found in DE 42 29 828 A1, WO 93/00472, and EP 0 136 284 A2. The separate binder threads are usually configured to be thinner than the threads forming the respective fabric layer (cf., for example, CA 1 115 177 A1), as the binder threads must be incorporated in the fabric structure in addition to the fabric forming threads. In this respect, little space is provided for such separate binder threads especially in a plain weave. Otherwise, the binder threads would interfere with the originally homogeneous structure of the weave, so that imperfections which cause markings in the paper would be produced especially in the plain weave provided on the paper side. However, practice has shown that the thin binder threads wear out and break rather fast in particular in paper machines which process a high amount of abrasive fillers or the construction of which puts heavy bending loads on the screens in the machine direction, so that the two fabric layers are first displaced and then separated as a result thereof. It goes without saying that it is impossible to make high quality paper by means of a fabric/screen changed in such a manner.

An alternative is the use of structural threads (belonging to/contributing to the structure and to the weave pattern, respectively, of at least one fabric layer) for connecting the layers. In this respect, the threads used for connecting the layers ("binding threads") on the one hand serve for connecting the layers, for which purpose they alternate between the layers, and, on the other hand, participate in forming the upper fabric and/or the lower fabric (especially the respective recurring characteristic weave or overlapping pattern). Different structural threads may be used as connecting threads, for example transverse threads (or alternatively longitudinal threads) which participate in structurally forming the upper fabric, the different structural threads bringing about different screen properties.

In addition/in this respect, it is known to use two transverse threads arranged adjacently in a longitudinal direction, which interact as a so-called functional transverse thread pair. In this respect, both transverse threads of a functional pair together alternately form a virtually uninterrupted transverse thread on the paper side, which fits in the weave pattern of the paper side and may, for example, form part of a paper side plain weave. Those thread portions of the functional pair which are currently not required for forming the virtually uninterrupted transverse thread on the paper side extend in the interior of the fabric and can be used for binding the lower fabric to the upper fabric. In this respect, the thread portion binding the lower fabric can, for example, complete the lower fabric or its weave at the same time. For example, one or both transverse threads of a functional pair may alternately extend in the upper fabric and the lower fabric. An upper transverse thread may, for example, be provided between two functional transverse thread pairs, which completes exclusively the plain weave (i.e. which extends only in the upper fabric), but has no binding function. Exemplary embodiments of this approach can be found, for example, in EP 0 097 966 A2, EP 794 283 A1, WO 99/06630 A1, WO 99/06632 A1, and WO 02/14601 A1.

Alternatively, the layers may be connected by so-called functional longitudinal thread pairs. EP 0 069 101 and EP 093 096 are pointed out as examples in this regard, showing a layer connection through functional longitudinal thread pairs.

With respect to the fabrics connected through functional transverse thread pairs, reference is in addition made to the following patent literature.

EP 1 021 616 B1 by Kevin J. Ward shows a fabric in which the paper side is exclusively formed by functional transverse thread pairs in the transverse direction, i.e. there are no pure upper transverse threads (see FIG. 1a of said patent). The paper side of such a screen has a comparatively high tendency to marking, as there is no support of the upper longitudinal threads and no stabilization of the upper fabric, respectively, by pure upper transverse threads. The paper side realized by a plain weave becomes irregular due to the missing upper transverse threads and the great number of changeover positions. Moreover, a great amount of transverse threads is used.

In patent EP 1 311 723 B1 by Heinz Odenthal a fabric is shown in which the paper side is exclusively formed by functional transverse thread pairs in the transverse direction, wherein only in every second pair one of the two transverse threads is formed as a binding thread which immerges in the lower fabric layer (see FIG. 3 of said patent). In addition to an increased tendency to marking, this fabric thus has a comparatively small number of binding positions (with a high number of introduced transverse threads).

EP 1 754 820 A1 by Johann Boeck shows a fabric in which two pure upper transverse threads and one functional transverse thread pair are arranged alternately one after another in a longitudinal direction on the paper side (see FIG. 1 of said publication). Due to the comparatively small number of functional transverse thread pairs, the number of binding positions is relatively low.

Fabrics in which one upper transverse thread and one functional transverse thread pair are arranged one after another in a longitudinal direction on the paper side are, for example, described in EP 1 000 197 B1 by Kevin J. Ward, EP 1 158 089 B1 by Kevin J. Ward, EP 1 158 090 B1 by Kevin J. Ward, WO 2010/041123 A2 by Clara Rosetti, EP 0 794 283 B1 by Dale B. Johnson et al., U.S. Pat. No. 5,826,627 by Ronald H. Seabrook, WO 2004/111333 A2 by Steward L. Hay and WO 2005/014926 A1 by Stewart L. Hay. Also these fabrics have a relatively high tendency to marking or an irregular paper side, as one upper longitudinal thread in two is supported exclusively by functional transverse thread pairs which form changeover positions. In other words, all pure upper wefts and upper transverse threads, respectively, rest on the same warp threads and upper longitudinal threads, respectively (especially on one warp thread in two).

Other examples show structures with a longitudinal thread ratio or warp thread ratio of upper fabric to lower fabric of unequal to 1 (in this respect, a ratio of 1:1 can be realized particularly easily). Solutions of this type are published in the patents EP 1 849 912 B1 by Kevin J. Ward, in which a warp ratio of upper fabric to lower fabric of 3 to 2 is described and in which, in addition, one functional transverse thread pair and one upper transverse thread are arranged one after another in a longitudinal direction on the paper side, and U.S. Pat. No. 7,487,805 B2 by Christine Baratte, Steward Hay and Kevin J. Ward, in which a weft-bound fabric having a warp ratio of upper warp to lower warp of less than 1 is described and in which, in addition, one functional transverse thread pair and two upper transverse threads are arranged one after another in a longitudinal direction on the paper side.

In both patents EP 1 002 892 B1 by Ralf Kaldenhoff and EP 2 205 791 B1 by Petra Hack-Ueberall and Arved Westerkamp, the simultaneous use of warp thread pairs and weft thread pairs is proposed as a solution for a stable layer connection.

The present invention now describes a paper machine screen which forms part of the group of screens/fabrics, the layers of which are connected through functional transverse thread pairs. Within this group, the screen according to the invention forms part of the subgroup where the two transverse threads of a respective functional pair alternately complete the upper weave (i.e. provide a structural, virtually uninterrupted transverse thread for the upper fabric layer) and only bind the lower weave or layer to the upper layer, i.e. do not contribute to forming the lower weave pattern. In addition, the screen according to the invention forms part of the subgroup in which both transverse threads of a respective transverse thread pair are formed as binding transverse threads, so that a great number of bindings can be achieved.

It is an object of the present invention to provide a sheet forming screen made of a multi-layer fabric, which meets the requirements described above at least in part, e.g. completely, (i.e., for example, comprises or combines a high fiber support, a low tendency to marking, an appropriate mechanical stability and a stable layer connection), and which, in addition, can be realized easily.

SUMMARY OF THE INVENTION

To achieve this object, the invention provides a paper machine screen formed as a transverse thread-bound multi-layer fabric having an upper fabric layer which comprises a first weave and a lower fabric layer comprising a second weave, wherein the multi-layer fabric has a total repeat which includes upper longitudinal threads which extend exclusively in the upper fabric layer and lower longitudinal threads which extend exclusively in the lower fabric layer, the ratio of upper longitudinal threads to lower longitudinal threads being 1:1, the lower longitudinal threads having a diameter which is greater than or equal to the diameter of the upper longitudinal threads, upper transverse threads which extend exclusively in the upper fabric layer and which are interwoven with the upper longitudinal threads, thereby partially forming the first weave, lower transverse threads which extend exclusively in the lower fabric layer and are interwoven with the lower longitudinal threads, thereby completely forming the second weave, wherein the lower transverse threads have a diameter which is greater than the diameter of the upper transverse threads, and binding transverse threads which respectively extend both in the upper fabric layer and in the lower fabric layer and hereby bind the lower fabric layer to the upper fabric layer, wherein, within the total repeat, the binding transverse threads form functional transverse thread pairs of respectively two binding transverse threads arranged directly next to each other, wherein the two binding transverse threads of a respective functional transverse thread pair alternately complete the first weave and, in doing so, respectively extend over one or more upper longitudinal threads, thereby forming an imaginary upper transverse thread, wherein the two binding transverse threads of a respective functional transverse thread pair alternately bind the lower fabric layer with the second weave completely formed by the lower longitudinal threads and the lower transverse threads to the upper fabric layer by the respective binding transverse thread of a respective functional transverse thread pair extending under at least one lower longitudinal thread during its course in the lower fabric layer within the total repeat, and wherein, in the total repeat, the functional transverse thread pairs in the upper fabric layer are arranged in groups of respectively two or more functional transverse thread pairs arranged directly one after another when seen in a longitudinal direction, wherein two successive groups are respectively separated from each other by one or two or more upper transverse threads. Further embodiments of the screen according to the invention are described in the dependent claims.

DETAILED DESCRIPTION OF THE INVENTION

The paper machine screen, for example sheet forming screen, according to the invention is formed as a transverse thread-bound, multi-layer (for example two-layer) fabric having an upper fabric layer comprising a first weave and a lower fabric layer comprising a second weave. The multi-layer fabric has a total repeat (for example it consists of the recurring total repeat) which includes the following threads (for example consists of the following threads). Upper longitudinal threads which extend exclusively in the upper fabric layer, lower longitudinal threads which extend exclusively in the lower fabric layer, upper transverse threads which extend exclusively in the upper fabric layer and are interwoven with the upper longitudinal threads, thereby in part forming the first weave, lower transverse threads which extend exclusively in the lower fabric layer and which are interwoven with the lower longitudinal threads, thereby completely forming the second weave, and binding transverse threads which respectively extend both in the upper fabric layer and in the lower fabric layer and thereby bind the lower fabric layer to the upper fabric layer.

The ratio of upper longitudinal threads to lower longitudinal threads is 1:1, the lower longitudinal threads have a diameter which is greater than or equal to the diameter of the upper longitudinal threads, and the lower transverse threads have a diameter which is greater than the diameter of the upper transverse threads.

Within the total repeat, the binding transverse threads form functional transverse thread pairs of respectively two binding transverse threads arranged directly next to each other, wherein the two binding transverse threads of a respective functional transverse thread pair alternately/in turns complete the first weave, thereby together forming an imaginary (uninterrupted) upper transverse thread (which fits/integrates into the weave pattern of the upper side and, for example, adopts the course of an upper transverse thread (with respect to the upper longitudinal threads) typical for the weave), and, in doing so, respectively extend above one or more upper longitudinal threads, and wherein the two binding transverse threads of a respective/each functional transverse thread pair alternately bind the lower fabric layer with the second weave completely formed by the lower longitudinal threads and the lower transverse threads to the upper fabric layer by the respective binding transverse thread of a respective functional transverse thread pair extending under at least one lower longitudinal thread during its course in the lower fabric layer within the total repeat.

In the total repeat, the functional transverse thread pairs in the upper fabric layer are arranged in groups of respectively two or more (for example exactly two) functional transverse thread pairs arranged directly one after another (especially without any upper transverse thread arranged therebetween) when seen in a longitudinal direction; in this regard, two subsequent groups are respectively separated from each other by one or two or more upper transverse threads.

In this respect, one characteristic feature of the screen according to the invention is the arrangement in groups (for example the arrangement in pairs) of the functional transverse thread pairs on the upper side of the screen, the individual groups being separated from each other by one or more pure upper transverse threads. In other words, two or more functional transverse thread pairs and one or more upper transverse threads are arranged alternately in a longitudinal direction on the paper side/upper side in the screen according to the invention. For example, (exactly) two functional transverse thread pairs and two upper transverse threads can be arranged alternately one after another in a longitudinal direction on the paper side/upper side in the screen according to the invention. Alternatively, for example (exactly) two functional transverse thread pairs and one upper transverse thread can be arranged alternately one after another in a longitudinal direction on the paper side/upper side in the screen according to the invention.

In other words, when compared to the initially described transverse thread-bound screens, an arrangement is used where the functional transverse thread pairs are grouped at least in pairs, i.e. where at least two functional transverse thread pairs directly following each other are provided in the longitudinal direction (without any upper transverse thread therebetween), instead of the alternating arrangement of "one functional transverse thread pair, one upper transverse thread", which arrangement results in sporadic/isolated functional transverse thread pairs.

A stable layer connection can be achieved using the screen according to the invention, with an appropriate amount of transverse threads and a longitudinal thread ratio which is easy to realize, as well as with a low tendency to marking of the paper side (due to a uniform configuration thereof).

On the lower side of the screen, the functional transverse thread pairs may also be arranged in groups (for example be arranged in pairs), the individual groups being separated from each other by one or more (for example exactly two) pure lower transverse threads. Alternatively or in addition, all binding transverse threads of a respective group of functional transverse thread pairs in the lower fabric layer may bind the lower fabric layer to the upper fabric layer between the same two associated lower transverse threads following one another in a longitudinal direction in the total repeat. Alternatively or in addition, the interspaces formed between the lower transverse threads may alternately be provided/occupied and not provided/non-occupied with connections by the binding transverse threads of a respective group of functional transverse thread pairs in the lower fabric layer when seen in a longitudinal direction.

For example, the two binding transverse threads of a respective transverse thread pair may alternately bind the lower fabric layer to the upper fabric layer by the respective binding transverse thread of a respective functional transverse thread pair extending under exactly one lower longitudinal thread during its course in the lower fabric layer within the total repeat.

For example, each binding transverse thread may extend under (at least) one other lower longitudinal thread in the lower fabric layer within a respective group of functional transverse thread pairs.

For example, the first weave may be a plain weave (for example an 8-, 10- or 12-shaft plain weave) which in the longitudinal direction is formed by the upper longitudinal threads and in the transverse direction by the upper transverse threads and the imaginary upper transverse threads formed by the functional transverse thread pairs. A plain weave is particularly advantageous for the paper side and has proven of value for the paper side, respectively, as explained above.

For example, the total repeat and/or the repeat of the upper fabric layer may contain 8, 10 or 12 upper longitudinal threads.

For example, the second weave may be a 5-shaft weave or a 10-shaft weave where the course of the respective lower transverse thread is repeated in a transverse direction after 5 and 10 lower longitudinal threads, respectively, wherein the course of the respective transverse thread is, for example, over one lower longitudinal thread and under four successive lower longitudinal threads or is, for example, over two successive lower longitudinal threads and under eight successive lower longitudinal threads.

For example, every lower longitudinal thread may be woven/bound-in by two binding transverse threads or four binding transverse threads in the total repeat. The respective longitudinal thread is thus woven/bound-in safely.

For example, the total repeat may contain: 10 upper longitudinal threads, 10 lower longitudinal threads, 10 upper transverse threads, 10 lower transverse threads and 20 binding transverse threads, which form 10 functional transverse thread pairs.

Alternatively, the total repeat may, for example, contain: 10 upper longitudinal threads, 10 lower longitudinal threads, 10 upper transverse threads, 20 lower transverse threads and 40 binding transverse threads, which form 20 functional transverse thread pairs.

For example, in the total repeat, for example in the entire multi-layer fabric, all longitudinal threads extending in the upper fabric layer may be upper longitudinal threads which extend exclusively in the upper fabric layer, and/or in the total repeat, for example in the entire multi-layer fabric, all longitudinal threads extending in the lower fabric layer may be lower longitudinal threads which extend exclusively in the lower fabric layer, and/or in the total repeat, for example in the entire multi-layer fabric, the upper fabric layer and the lower fabric layer may be connected to each other exclusively by the binding transverse threads arranged to form functional transverse thread pairs. Therefore, for example separate binder threads (not belonging to/fitting into the structure and the weave pattern, respectively) can be dispensed with entirely; this also applies to binding longitudinal threads.

For example, the upper transverse threads may be made of polyester and the binding transverse threads may be made of polyamide.

For example, the binding transverse threads may be smaller in diameter than the lower transverse threads. Thereby, the paper side may be formed to be finer, and the binding transverse threads do not interfere with the lower weave and can, in addition, be protected against wear by the thicker lower transverse threads on the machine side. For example, the binding transverse threads may be equal in diameter to the upper transverse threads and/or may be equal in diameter to the upper longitudinal threads, so that they fit well into the upper overlapping pattern. That is, for example, upper transverse threads, binding transverse threads and upper longitudinal threads may all be equal in diameter.

For example, the total repeat may comprise in the upper fabric layer, for example also in the lower fabric layer, altogether five groups or ten groups of functional pairs.

For example, the longitudinal threads are formed as warps threads and the transverse threads are formed as weft threads.

For example, in the total repeat, the ratio of upper transverse threads, including functional transverse thread pairs, to lower transverse threads may be greater than 1, for example 2:1, for example 20:10, or 3:2, for example 30:20. Thus, with a longitudinal thread ratio of 1:1 and a small thread diameter for the upper transverse threads, the screen according to the invention can have a high degree of fineness on the paper side in order to provide an appropriate fiber support. The machine side may have an increased openness for good draining/dewatering properties and a reduced tendency to congestion of the fabric with fibers and impurities when compared to the paper side. The machine side has, in particular, a high mechanical stability against expansion. The internal wear and in the end a layer separation may be avoided or severely reduced in the multi-layer sheet forming screen, the fabric layers of which are connected by upper transverse threads.

For example, the ratio of upper transverse threads to functional transverse thread pairs may be 1:1 or 1:2 in the total repeat, which ratios ensure an appropriate number of binding positions, the number of binding positions being increased in the latter case.

According to the invention, a fine fabric with a very homogeneous design may therefore be used for sheet forming and may be bound to a stable and coarser lower fabric. The upper fabric is, for example, realized in a plain weave and is therefore optimally suited for the production of graphic paper. The lower fabric is configured to be coarser in particular in the longitudinal direction, and may, for example, have the following advantages: solid matter potentially having entered the fabric through the upper fabric is not kept in the lower fabric; the draining performance of the screen is exclusively determined by the paper side; the lower fabric is open to such a degree that its influence on the total flow is subordinate. The coarse lower fabric is used in particular for optimizing the entire screen with respect to mechanical stability and resistance to wear and fabric thickness.

For example, each functional transverse thread pair may form exactly two cross positions/intersections in the total repeat, where the two binding transverse threads belonging to a pair intersect (for example below an upper longitudinal thread) and change into the respectively other fabric layer. Alternatively or in addition, the intersections of all functional transverse thread pairs may be distributed evenly to the upper longitudinal threads within the total repeat, so that the same number of intersections is positioned under each upper longitudinal thread and along each upper longitudinal thread, respectively, for example exactly two or exactly four. Thereby, a uniform paper side can be provided.

Further variations of the screen according to the invention can be derived from the following description of exemplary embodiments.

Hereinafter, some of the terms used in this application shall be defined:

Longitudinal threads are threads of the screen/fabric which extend in the longitudinal direction or longitudinal extension of the screen and are arranged in the running direction of the paper machine in operation. In the flat woven screen, the longitudinal threads are formed by the warp threads of the weaving loom. Circular woven fabrics, in contrast, realize the longitudinal threads by means of wefts.

Transverse threads are threads of the screen/fabric which extend in a transverse direction of the screen and are arranged transverse to the running direction of the paper machine in operation. In the flat woven screen, the transverse threads are formed by the wefts. Circular woven fabrics, in contrast, realize the transverse threads by means of the warps of the weaving loom.

A fabric layer is usually understood as being a single-layer fabric comprising or consisting of interwoven transverse threads and longitudinal threads (or warps and wefts).

The upper fabric or the upper fabric layer is a fabric layer which is usually formed in a particularly fine manner, which usually forms the paper side (=the upper side of the upper fabric oriented outwards) of the screen, on which the paper fiber layer is formed. The upper layer is located on the "logical upper side" of the screen.

The lower fabric or the lower fabric layer is a fabric layer which is usually formed in a particularly robust manner, which usually forms the machine side (=the lower side of the lower fabric oriented outwards) of the screen, which comes in direct contact with the driving and draining members of the paper machine generating wear.

Upper longitudinal threads are threads which are located exclusively in the upper fabric and which are there interwoven with transverse threads extending in the upper fabric. Upper longitudinal threads never leave the upper fabric, i.e. they do not change into the lower fabric.

Upper transverse threads are threads which are exclusively located in the upper fabric and which are there interwoven with the upper longitudinal threads. Upper transverse threads extend exclusively in the upper fabric and do not change into the lower fabric.

According to the invention, upper transverse threads and upper longitudinal threads together partially form the first, upper weave, which weave is completed by the binding transverse threads and the functional pairs (see below), respectively. I.e., metaphorically speaking, gaps are formed in the upper fabric by omitting a predetermined number of upper transverse threads, which are closed again by the functional pairs. Advantageously, the first, upper weave is a plain weave.

Lower longitudinal threads are threads which are located exclusively in the lower fabric and which are there interwoven with transverse threads extending in the lower fabric. The lower longitudinal threads do not leave the lower fabric, i.e. they do not change into the upper fabric.

Lower transverse threads are threads which are located exclusively in the lower fabric and which are there interwoven with the lower longitudinal threads. The lower transverse threads do not leave the lower fabric, i.e. they do not change into the upper fabric.

According to the invention, lower transverse threads and lower longitudinal threads together form the complete second, lower weave.

Binding transverse threads are transverse threads which extend both in the upper fabric layer and in the lower fabric layer and hereby bind the lower fabric layer to the upper fabric layer.

A functional transverse thread pair is formed by two binding transverse threads arranged directly next to each other (also see the above-made comments as to functional transverse thread pairs). According to the invention, both transverse threads of a functional transverse thread pair together form an imaginary (uninterrupted) upper transverse thread at the upper side, which fits into the weave pattern of the upper side, i.e. they alternately complete the first weave and, in doing so, extend over respectively one or more upper longitudinal threads. Those thread portions of the functional pair which are currently not required for forming the virtually uninterrupted transverse thread on the paper side, may be used for binding the lower fabric to the upper fabric. According to the invention, both transverse threads of a respective functional transverse thread pair alternately bind the lower fabric layer with the second weave entirely formed by the lower longitudinal threads and the lower transverse threads to the upper fabric layer in this regard, by the respective transverse thread of a respective functional transverse thread pair extending under at least one (for example exactly one) lower longitudinal thread during its course in the lower fabric layer. I.e., both transverse threads of a respective functional pair are formed as binding transverse threads according to the invention.

The total repeat of the fabric is a recurring weave pattern/thread overlapping pattern of the entire fabric (including the upper fabric and the lower fabric), in particular the smallest repeating unit in the entire fabric; in this respect, the course of all threads (upper and lower longitudinal threads, upper and lower transverse threads, binding transverse threads) with respect to each other is taken into consideration, in particular the course of the respective thread in all/both layers. Knowing the total repeat, the entire fabric and screen, respectively, can therefore be produced. I.e. the screen and the fabric, respectively, can consist of a plurality of total repeats directly strung/connected together.

The weave repeat of the upper fabric and the so-called upper weave repeat, respectively, is a recurring pattern and a repeating unit, respectively, in the upper fabric of interwoven upper longitudinal threads, upper transverse threads and binding transverse threads, in particular the smallest repeating unit in the upper fabric. In a plan view onto the upper fabric or the paper side of the screen, a plurality of such upper weave repeats can be seen in the longitudinal and transverse directions of the screen. Hence, the upper weave repeat especially represents the recurring overlapping pattern of the upper fabric in the top view of the upper fabric formed by the upper longitudinal threads, the upper transverse threads and the binding transverse threads (especially also in consideration of the changeover positions of the functional pairs). In other words, the upper weave repeat concerns the course of the upper transverse threads and binding transverse threads with respect to the upper longitudinal threads and the resulting overlapping pattern; the course of the binding transverse threads with respect to the lower longitudinal threads has no importance for determining the upper weave repeat. If for the respective functional transverse thread pair one considers only the upper virtual/imaginary transverse thread formed thereby (without taking into consideration the changeover position(s)), one will obtain the so-called virtual/imaginary upper weave repeat which, for example, may be realized in the shape of a plain weave.

The weave repeat of the lower fabric and the so-called lower weave repeat, respectively, is a recurring pattern and a repeating unit, respectively, in the lower fabric, of interwoven lower longitudinal threads and lower transverse threads, especially the smallest repeating unit in the lower fabric. In a plan view of the lower fabric and the machine side of the screen, respectively, a plurality of such lower weave repeats can be seen in a longitudinal and transverse directions of the screen. Hence, the lower weave repeat especially represents the recurring overlapping pattern of the lower fabric formed in the top view of the lower fabric by the lower longitudinal threads and the lower transverse threads (especially without considering the binding positions through the functional pairs, as they do not contribute to the weave). In other words, the lower weave repeat concerns the course of the lower transverse threads with respect to the lower longitudinal threads and the resulting overlapping pattern; the course of the binding transverse threads in the lower fabric has no importance for the lower weave repeat.

The invention will hereinafter be described in more detail by means of different exemplary embodiments and with reference to the drawings.

BRIEF DESCRIPTION OF THE DRAWINGS

In FIGS. 3 to 6, the functional transverse thread pairs respectively form an imaginary upper transverse thread, which together with the upper transverse threads or the upper transverse thread and the upper longitudinal threads form a plain weave. The changeover positions of the next subunit (not shown) following in a longitudinal direction may be offset in a transverse direction. The respective characteristic subunit includes—other than in the state of the art according to FIGS. 1 and 2—two functional transverse thread pairs which are directly adjacent to each other in the longitudinal direction.

DETAILED DESCRIPTION OF THE DRAWINGS

Hereinafter, the invention shall be explained in more detail by means of two exemplary embodiments with reference to the drawings.

However, first of all, a characteristic feature of the screen/fabric according to the invention is to be explained in more detail with reference to FIGS. 1 to 6.

Figure 1:
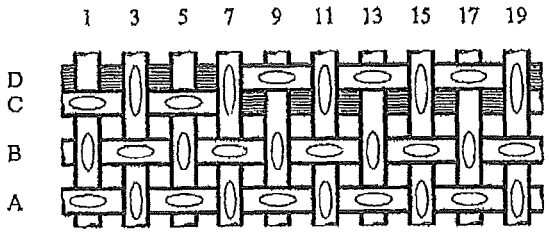
prior art Fig. 1
FIG. 1 shows a detail of a known screen, especially of its upper fabric layer, wherein the characteristic arrangement/subunit of two successive upper transverse threads and one functional transverse thread pair, recurring on the paper side in a longitudinal direction is shown, i.e. two upper transverse threads and one functional transverse thread pair are alternately arranged one after another in a longitudinal direction on the paper side. In addition, it can be seen that a 10-shaft weave is concerned, i.e. the transverse thread course (especially the course of the binding transverse threads) is repeated after 10 upper longitudinal threads. The functional transverse thread pair forms an imaginary upper transverse thread which forms a plain weave together with both upper transverse threads and the upper longitudinal threads. The changeover positions of the next subunit (not shown) following in a longitudinal direction may be offset in a transverse direction. The characteristic subunit only includes one functional transverse thread pair.

FIG. 1 shows a detail/section of the upper fabric layer of a known screen, which illustrates the characteristic subunit of two successive upper transverse threads and one functional transverse thread pair, always recurring on the paper side when seen in a longitudinal direction (here for a 10-shaft plain weave, i.e. the transverse thread course is repeated after 10 longitudinal threads and the transverse threads form a plain weave together with the longitudinal threads). I.e., according to this known screen, one pair of upper transverse threads and one functional transverse thread pair are alternately arranged on the paper side in a longitudinal direction.

Figure 2:
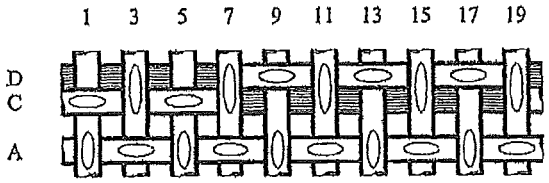
FIG. 2 shows a detail of another known screen, especially of its upper fabric layer, wherein the characteristic arrangement/subunit of one upper transverse thread and one functional transverse thread pair, recurring on the paper side in a longitudinal direction, is shown, i.e. one upper transverse thread and one functional transverse thread pair are alternately arranged one after another in a longitudinal direction on the paper side. In addition, it can be seen that a 10-shaft weave is concerned, i.e. the transverse thread course (especially the course of the binding transverse threads) is repeated after 10 upper longitudinal threads. The functional transverse thread pair forms an imaginary upper transverse thread which forms a plain weave together with the upper transverse thread and the upper longitudinal threads. The changeover positions of the next subunit (not shown) following in a longitudinal direction may be offset in a transverse direction. The characteristic subunit only contains one functional transverse thread pair.

FIG. 2 shows a detail/section of the upper fabric layer of another known screen, which illustrates the characteristic subunit of one upper transverse thread and one functional transverse thread pair, always recurring on the paper side when seen in a longitudinal direction (again for a 10-shaft plain weave). I.e., according to this known screen, one upper transverse thread and one functional transverse thread pair are alternately arranged on the paper side in a longitudinal direction.

Figure 3:
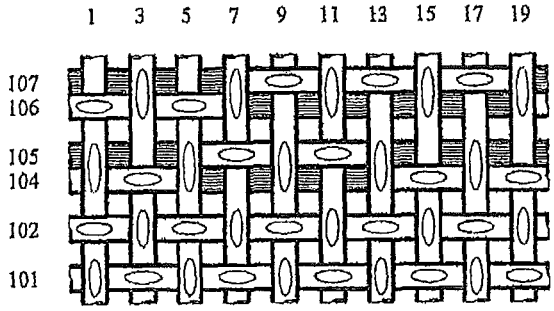
FIG. 3 shows a detail of a screen according to the invention, especially of its upper fabric layer, wherein the characteristic arrangement/subunit of two (directly) successive upper transverse threads and two (directly) successive functional transverse thread pairs, recurring on the paper side/upper side in a longitudinal direction, is shown (both upper transverse threads and both functional transverse thread pairs are respectively arranged in pairs), i.e., one pair of upper transverse threads and one pair of functional transverse thread pairs are alternately arranged one after another in a longitudinal direction on the paper side. In addition, it can be seen that a 10-shaft weave is concerned, i.e. the transverse thread course (especially the course of the binding transverse threads) is repeated after 10 upper longitudinal threads.
Figure 4:
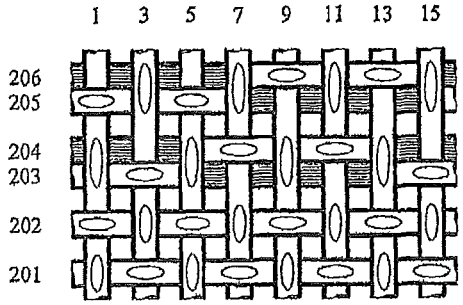
FIG. 4 shows a detail of a screen according to the invention, especially of its upper fabric layer, wherein the characteristic arrangement/subunit of two successive upper transverse threads and two successive functional transverse thread pairs, recurring on the paper side/upper side in a longitudinal direction is shown, i.e., one pair of upper transverse threads and one pair of functional transverse thread pairs are alternately arranged one after another on the paper side. In addition, it can be seen that an 8-shaft weave is concerned, i.e. the transverse thread course (especially the course of the binding transverse threads) is repeated after 8 upper longitudinal threads.
Figure 5:
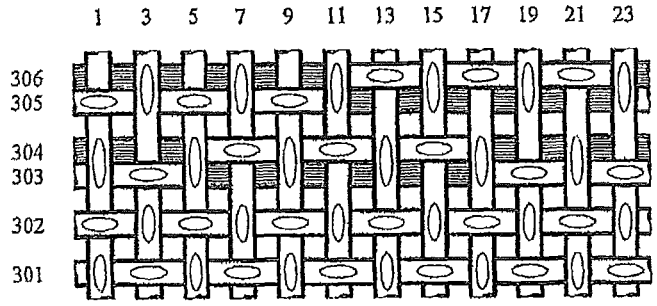
FIG. 5 shows a detail of a screen according to the invention, especially of its upper fabric layer, wherein the characteristic arrangement/subunit of two successive upper transverse threads and two successive functional transverse thread pairs, recurring on the paper side/upper side in a longitudinal direction, is shown, i.e., one pair of upper transverse threads and one pair of functional transverse thread pairs are arranged alternately one after another in a longitudinal direction on the paper side. In addition, it can be seen that a 12-shaft weave is concerned, i.e. the transverse thread course (especially the course of the binding transverse threads) is repeated after 12 upper longitudinal threads.

FIGS. 3 to 5 each show a detail/section of a screen according to the invention, especially of its upper fabric layer, which illustrates the respective characteristic subunit of two successive upper transverse threads and two successive functional transverse thread pairs, recurring on the paper side/upper side in a longitudinal direction. I.e., according to these fabrics/screens according to the invention, one pair of upper transverse threads and one pair of functional transverse thread pairs are alternately arranged one after another on the paper side in a longitudinal direction. FIG. 3 shows this for the case of a 10-shaft plain weave, FIG. 4 for the case of an 8-shaft plain weave, and FIG. 5 for the case of a 12-shaft plain weave.

Figure 6:
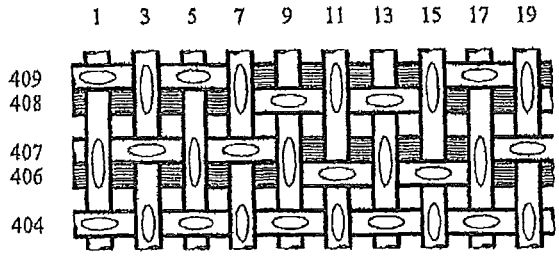
FIG. 6 shows a detail of a screen according to the invention, especially of its upper fabric layer, wherein the characteristic arrangement/subunit of one upper transverse thread and two successive functional transverse thread pairs, recurring on the paper side/upper side in a longitudinal direction is shown, i.e., one upper transverse thread and one pair of functional transverse thread pairs are arranged alternately one after another in a longitudinal direction on the paper side. In addition, it can be seen that a 10-shaft weave is concerned, i.e. the transverse thread course (especially the course of the binding transverse threads) is repeated after 10 upper longitudinal threads.

FIG. 6 shows a detail/section of a screen according to the invention, especially of its upper fabric layer, wherein the characteristic subunit of one upper transverse thread and two successive functional transverse thread pairs, recurring on the paper side/upper side in a longitudinal direction, is shown (by way of example for a 10-shaft plain weave). I.e., one upper transverse thread and one pair of functional transverse thread pairs are alternately arranged one after another on the paper side in a longitudinal direction.

Other than in the state of the art according to FIGS. 1 and 2, where functional transverse thread pairs are arranged individually in a longitudinal direction on the paper side and are separated from each other by upper transverse threads (or rather where the characteristic subunit only contains one functional transverse thread pair), the functional transverse thread pairs according to the invention are arranged in groups separated from each other by upper transverse threads, for example in pairs, on the paper side (or rather the characteristic subunit contains functional transverse thread pairs which are directly adjacent to each other).

Figure 7A:
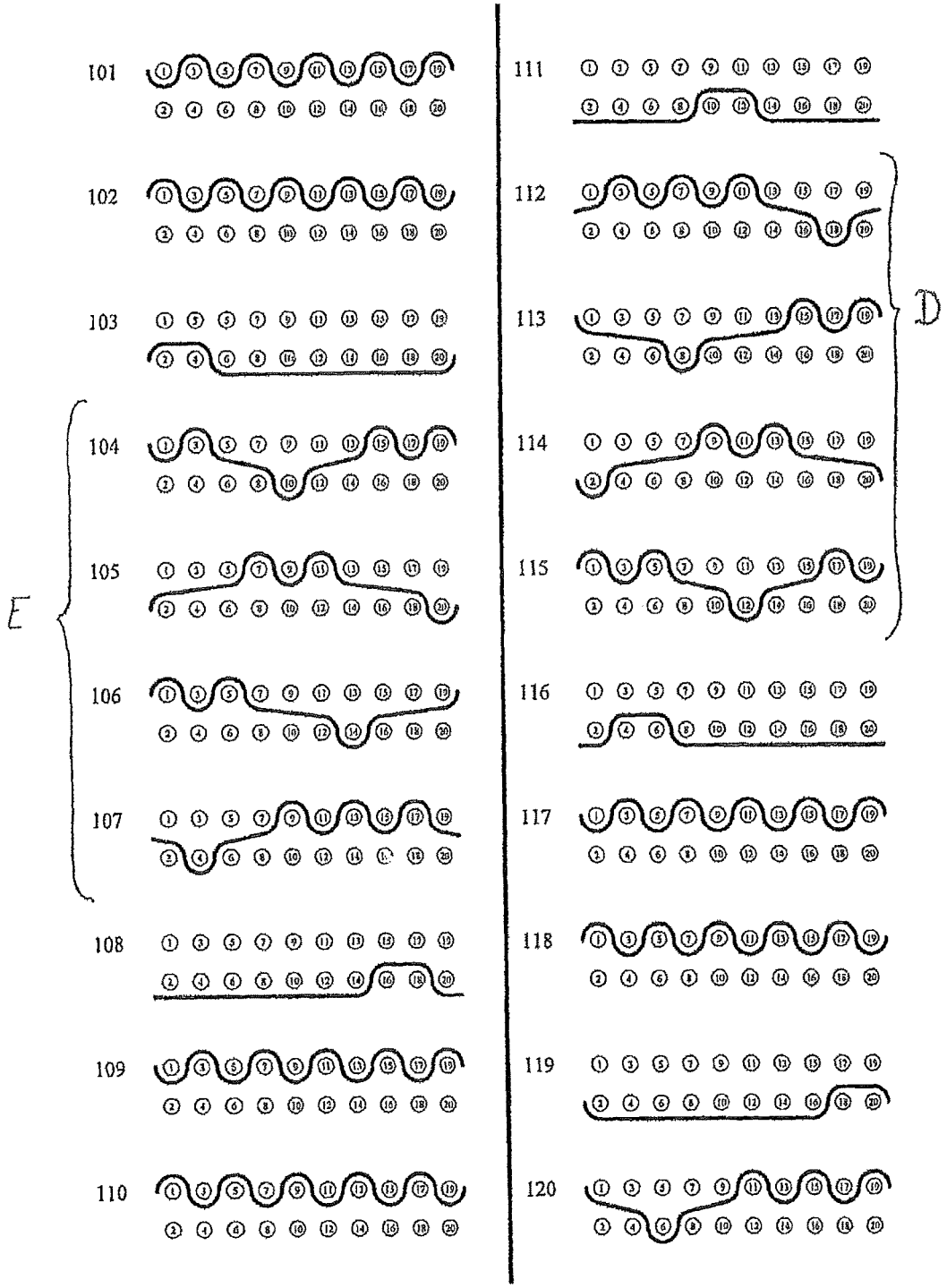
FIGS. 7*a* and 7*b* show the total repeat of a multi-layer fabric serving as a paper machine screen, especially as a sheet forming screen, according to a first embodiment of the invention, especially the courses of all transverse threads of the total repeat with respect to the lower and upper longitudinal threads.
Figure 7B:
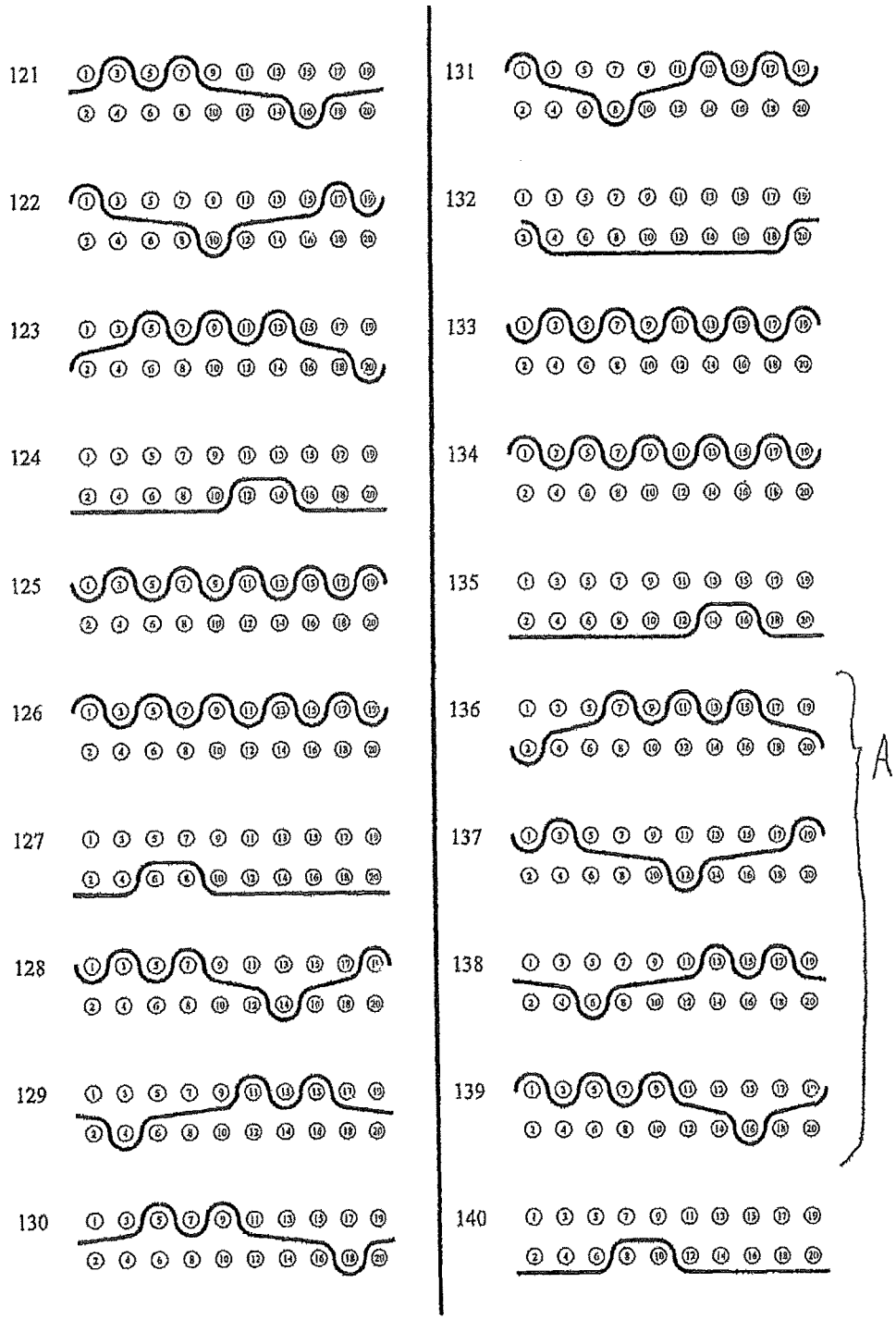
Figure 8:
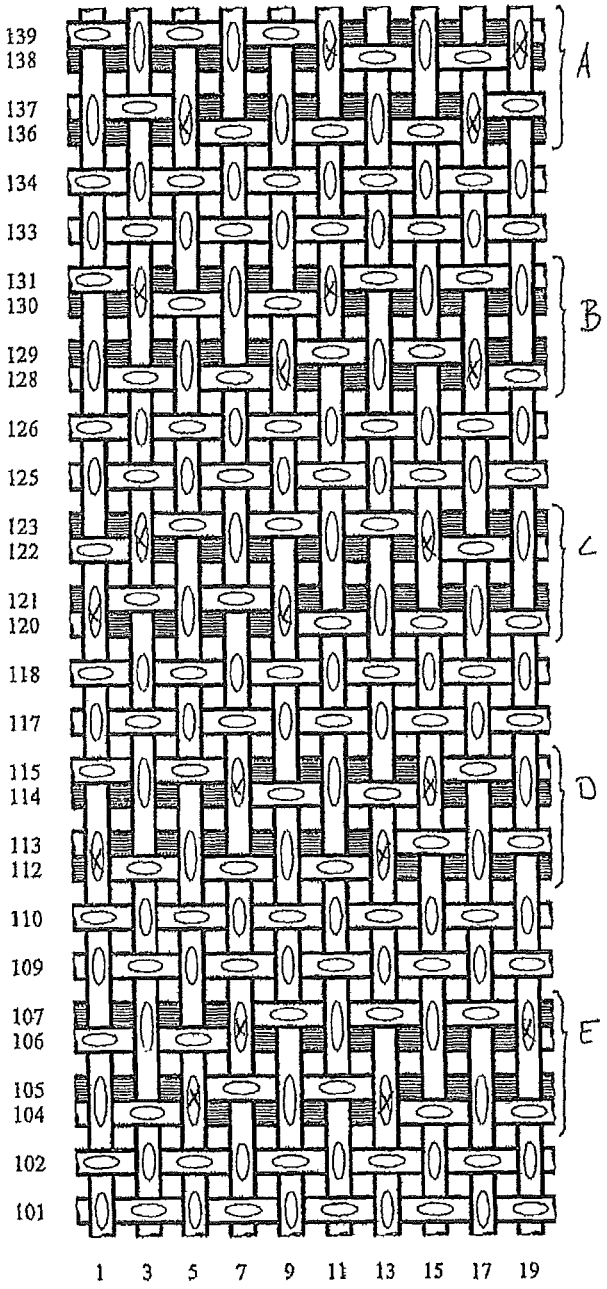
FIG. 8 shows a top view of the upper fabric layer of the total repeat. This corresponds at the same time to a top view of the weave repeat of the upper fabric layer.
Figure 9:
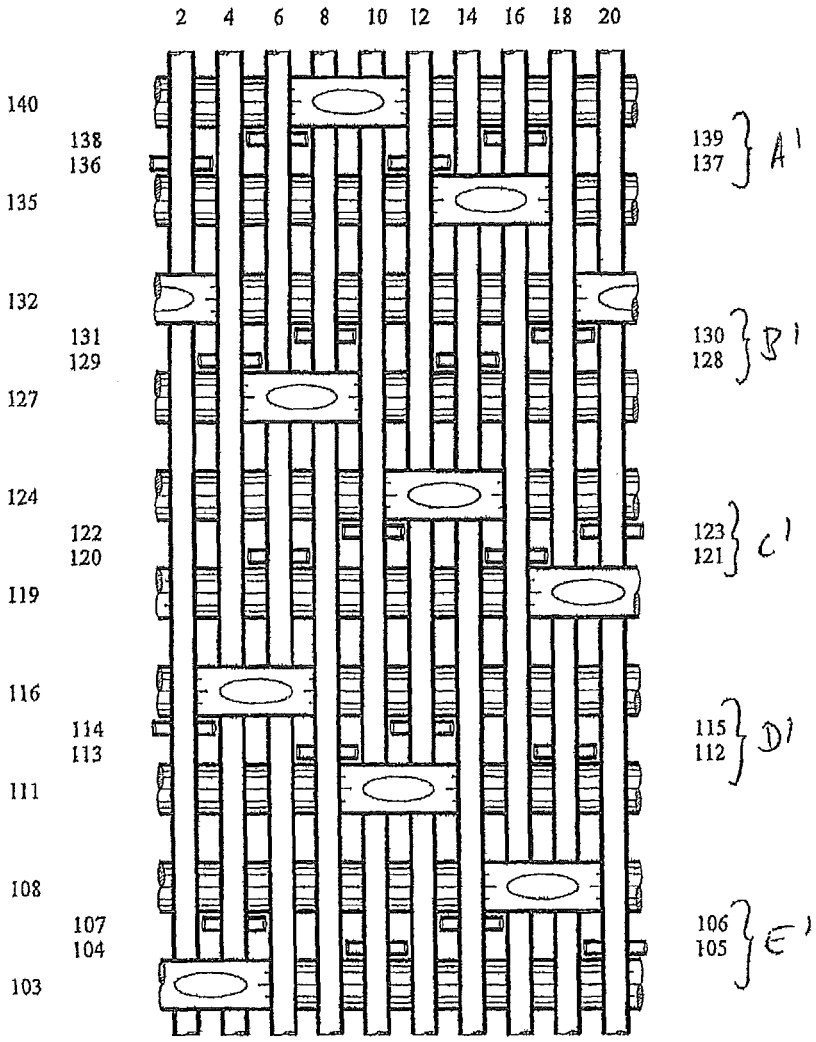
FIG. 9 shows a top view of the lower fabric layer of the total repeat. This corresponds at the same time to a top view of the weave repeat of the lower fabric layer.
Figure 10A:
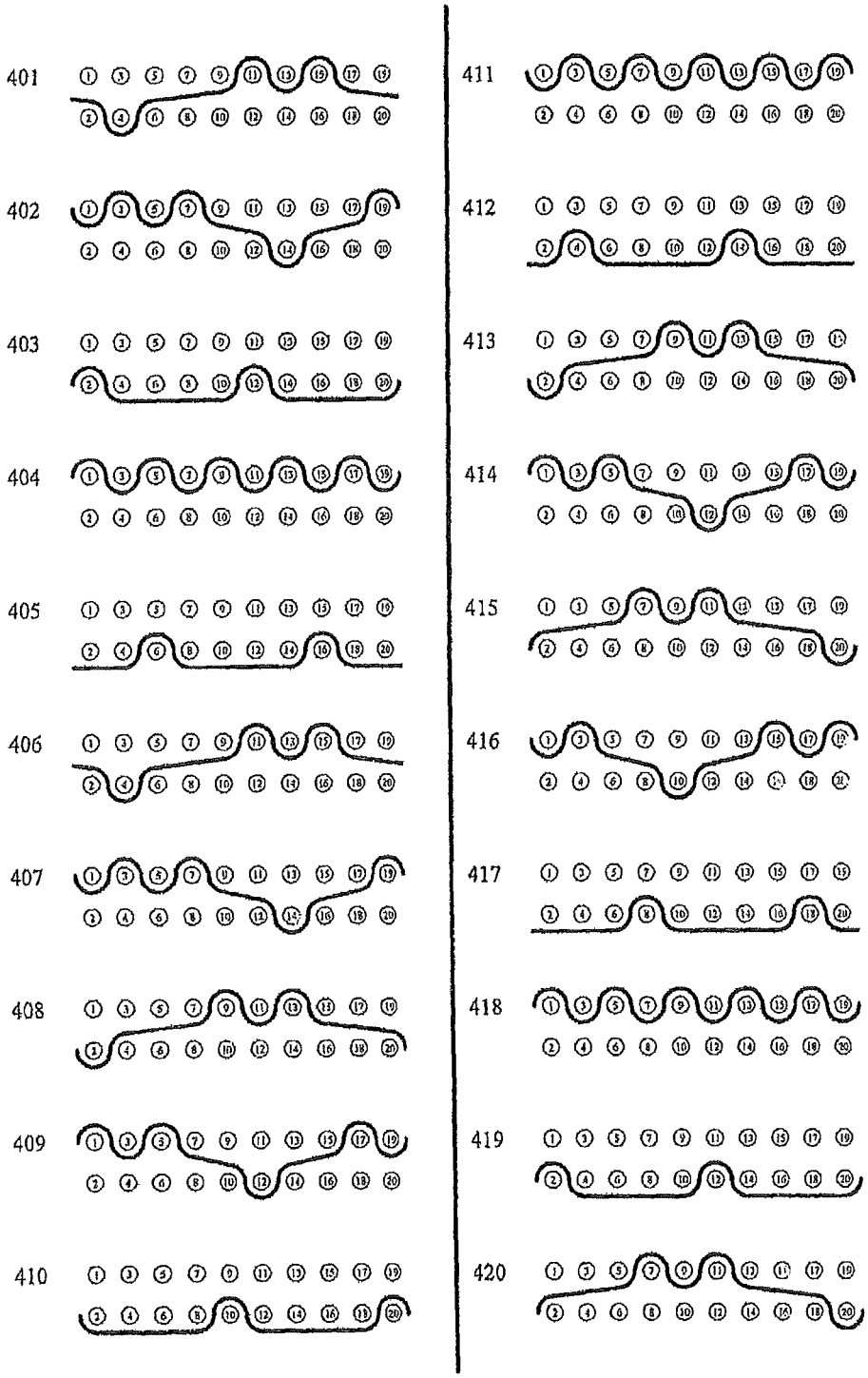
FIGS. 10*a* to 10*d* show the total repeat of a multi-layer fabric serving as a paper machine screen, especially as a sheet forming screen, according to a second embodiment of the invention, in particular the courses of all transverse threads of the total repeat with respect to the lower and upper longitudinal threads.
Figure 10B:
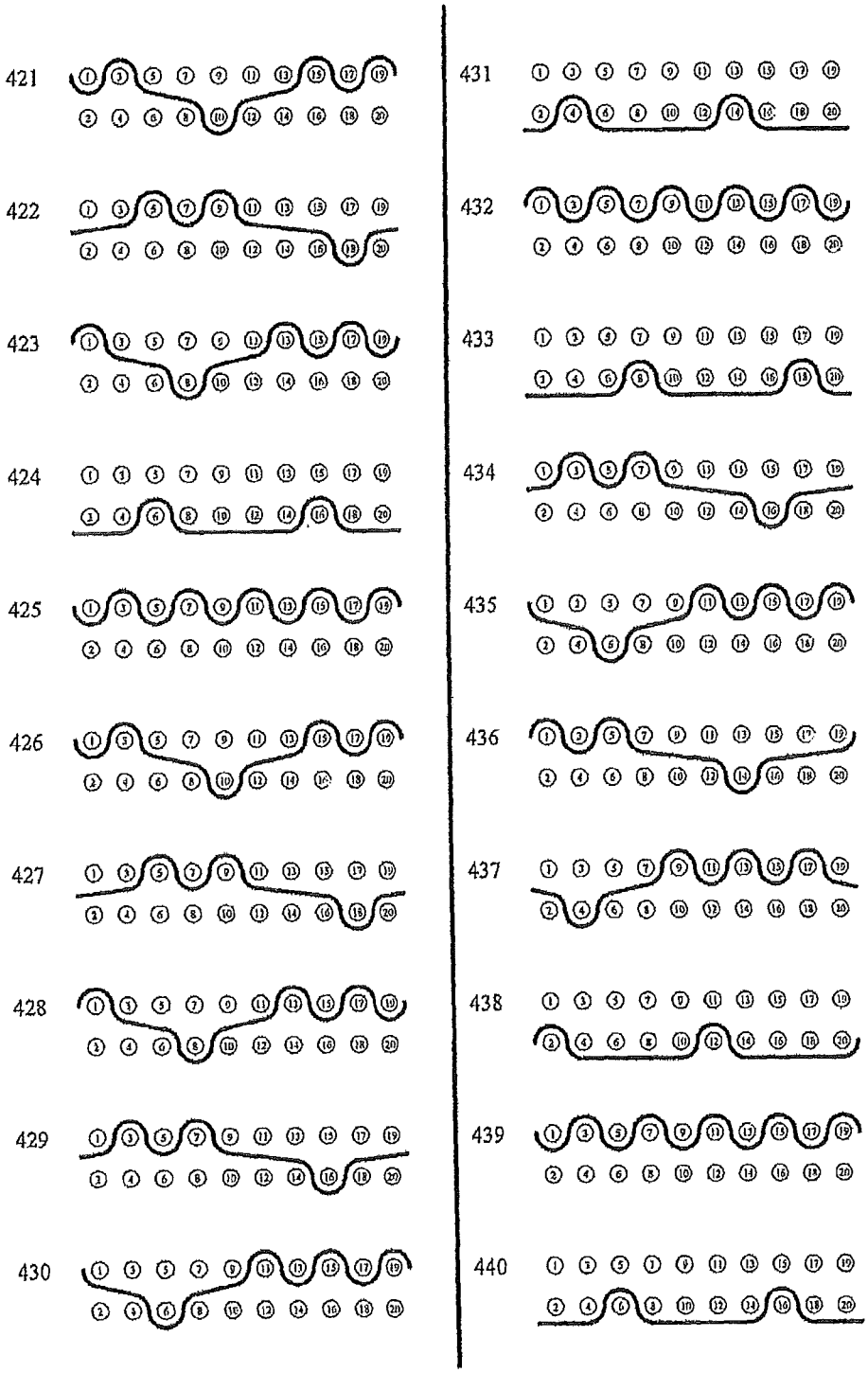
Figure 10C:
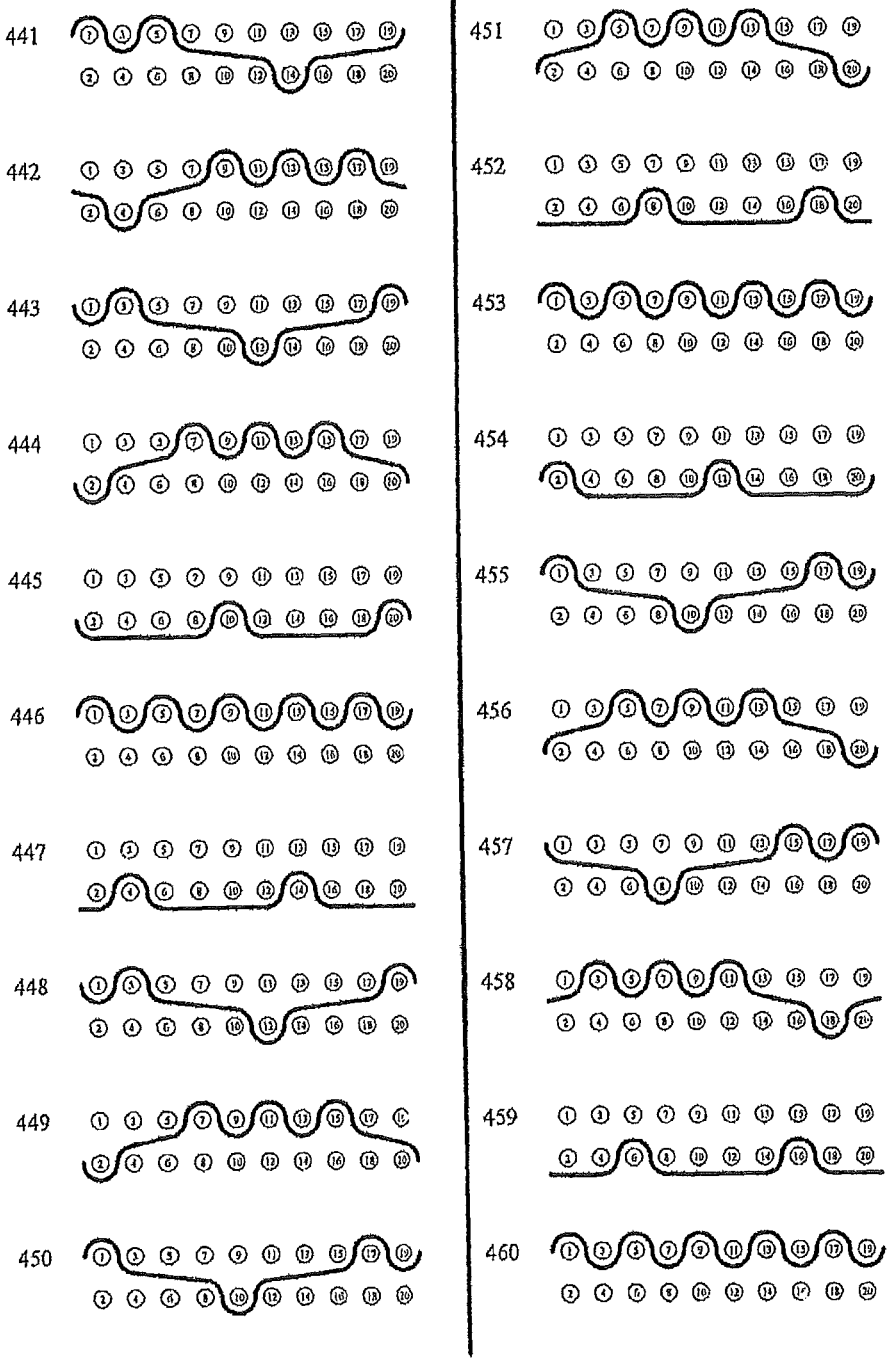
Figure 10D:
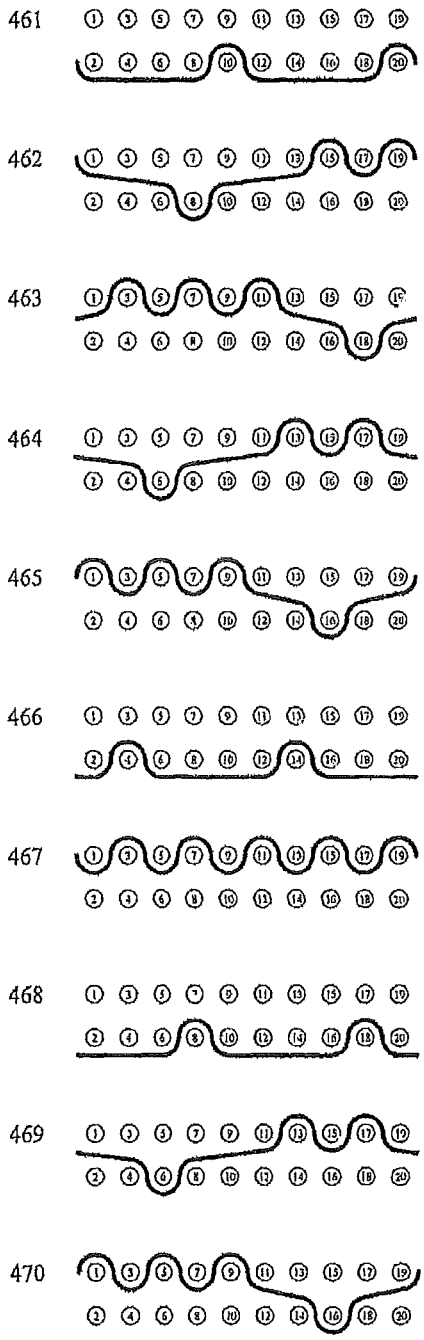

FIGS. 7*a*, 7*b*, 8 and 9 show the total repeat of a multi-layer fabric according to a first embodiment of the invention, serving as a paper machine screen, especially as a sheet forming screen, wherein FIGS. 7*a* and 7*b* show the courses of all transverse threads (upper, lower and binding transverse threads) of the total repeat with respect to the lower and upper longitudinal threads, wherein FIG. 8 shows a top view of the upper fabric layer (and the upper side, respectively) of the total repeat, and wherein FIG. 9 shows a top view of the lower fabric layer of the total repeat. The threads extending from the left-hand side to the right-hand side in the Figures are transverse threads (for example weft threads), and the threads extending bottom-up in the Figures are longitudinal or machine direction threads (for example warp threads).

As can be seen in the Figures, the multi-layer fabric has an upper fabric layer comprising a first weave (see FIG. 8; for example, the upper fabric layer forms the so-called paper side of the screen), and a lower fabric layer comprising a second weave (see FIG. 9; for example, the lower fabric layer forms the so-called machine side of the screen). These two fabric layers are connected to each other or held together by (binding) transverse threads (see FIGS. 7*a*, 7*b* and 9), so that the fabric can be referred to as transverse thread-connected or transverse thread-bound fabric. For example, the upper fabric layer and the lower fabric layer in the total repeat, especially in the entire multi-layer fabric, may be connected to each other exclusively by the binding transverse threads arranged to form functional transverse thread pairs, i.e., for example, may be free from separate binder threads and/or binding longitudinal threads.

The multi-layer fabric is formed by (for example consists of or is exclusively formed by) a total repeat (repeating in the fabric), which includes the following types of threads: upper longitudinal threads 1, 3, 5, 7, 9, etc., which extend exclusively in the upper fabric layer, lower longitudinal threads 2, 4, 6, 8, 10, etc., which extend exclusively in the lower fabric layer, upper transverse threads 101, 102, 109, 110, 117, 118, 125, 126, etc., which extend exclusively in the upper fabric layer and are interwoven with the upper longitudinal threads, thereby partially forming the first weave, lower transverse threads 103, 108, 111, 116, 119, 124, 127, etc., which extend exclusively in the lower fabric layer and are interwoven with the lower longitudinal threads, thereby completely forming the second weave, and binding transverse threads 104 to 107, 112 to 115, 120 to 123, etc., which extend each both in the upper fabric layer and in the lower fabric layer (i.e., these threads interchange between the two fabric layers), and thereby bind the lower fabric layer to the upper fabric layer.

The ratio of upper longitudinal threads 1, 3, 5, 7, 9, etc. to lower longitudinal threads 2, 4, 6, 8, 10, etc. is 1:1. As can be seen in the Figures, the ratio of upper longitudinal threads to lower longitudinal threads may, for example, be 10:10 (alternatively, for example, 12:12 or 8:8) in the total repeat. I.e., the course of the binding threads of a respective transverse thread pair (with respect to the lower and upper longitudinal threads) may be repeated in a transverse direction after 8, 10 or 12 upper longitudinal threads.

The lower longitudinal threads 2, 4, 6, 8, 10, etc. have a diameter which is greater than or equal to the diameter of the upper longitudinal threads 1, 3, 5, 7, 9, etc. As can be seen in the Figures, upper and lower longitudinal threads may, for example, be equal in diameter. The total repeat and especially the entire fabric may be formed in the longitudinal direction exclusively using upper and lower longitudinal threads. I.e., all longitudinal threads extending in the upper fabric layer in the total repeat, especially in the entire multi-layer fabric, can be upper longitudinal threads which extend exclusively in the upper fabric layer. Moreover, all longitudinal threads extending in the lower fabric layer in the total repeat, especially in the entire multi-layer fabric, can be lower longitudinal threads which extend exclusively in the lower fabric layer.

As can be seen in FIGS. 8 and 9, the lower transverse threads 103, 108, 111, 116, 119, 124, 127, etc. have a diameter which is greater than the diameter of the upper transverse threads 101, 102, 109, 110, 117, 118, 125, 126, etc. I.e., the lower transverse threads are formed to be thicker than the upper transverse threads. The lower side of the screen coming into contact with the paper machine can be configured to be robust by means of the thicker lower transverse threads, whereas the upper side of the screen coming into contact with the fiber suspension can be configured to be fine by means of the thinner upper transverse threads. The binding transverse threads 104 to 107, 112 to 115, 120 to 123 are, for example, also formed to be thinner than the lower transverse threads, and, in addition, have for example the same diameter as the upper transverse threads, so that the imaginary upper transverse thread formed by the respective functional pair fits well into the weave pattern of the upper weave. Due to the fact that the lower longitudinal threads and the lower transverse threads do not change into the upper layer, the fine paper side is not interfered with by the robust lower threads. The comparatively thin, binding transverse threads which change into the lower layer, interfere with the lower weave only insignificantly. Moreover, the comparatively thick lower transverse threads project further downwards than the binding transverse threads during their presence in the lower layer, whereby the binding transverse threads are shielded by the lower transverse threads and protected against wear.

The ratio of upper transverse threads to lower transverse threads may, for example, be 1:1, for example 10:10. Under consideration of the functional transverse thread pairs or rather the imaginary upper transverse threads formed thereby, the ratio (upper transverse threads+imaginary upper transverse threads)/lower transverse threads is, for example, 2:1, for example 20:10. In other words, the paper side/upper side of the screen may be formed to be finer than the comparatively coarse machine side/lower side of the screen. In this respect, the functional transverse thread pairs are associated with/assigned to the upper fabric layer, since they contribute to forming the first weave there, whereas they only serve for binding in the lower fabric layer. The ratio of upper transverse threads to functional pairs may, for example, be 1:1, for example 10:10. The upper transverse threads may, for example, be made of polyester, and the binding transverse threads may, for example, be made of polyamide.

As can be seen especially in FIG. 8, the binding transverse threads form so-called functional transverse thread pairs 104+105, 106+107, 112+113, etc. from/of respectively two binding transverse threads directly arranged next to each other within the total repeat. Both binding transverse threads of a respective functional transverse thread pair alternately/in turns complete the first weave, thereby forming an imaginary uninterrupted upper transverse thread, and, in doing so, respectively extend over one or more upper longitudinal threads. Thereby (by the changeover), so-called changeover or cross positions are formed underneath an associated longitudinal thread, which are marked with an "x" in FIG. 8 and at which one thread of a pair changes to the upper side and the other thread of the pair changes to the lower side. As can be seen in FIG. 8, each functional transverse thread pair may, for example, have/form exactly two changeover positions per total repeat.

For example, the changeover positions/intersections of all functional pairs may be evenly distributed to the upper longitudinal threads within the total repeat, for example two changeover positions being allotted to every upper longitudinal thread. For example, the two changeover positions of a respective pair may rise through the total repeat with a pitch of "by 3 upper longitudinal threads to the left". The functional pair of the next total repeat (in a longitudinal direction above the repeat shown) following the functional pair 138+139 then has a course (including the changeover positions) which is identical to that of the functional pair 104+105. Both binding transverse threads of a respective functional transverse thread pair alternately bind the lower fabric layer with the second weave completely formed by the lower longitudinal threads and the lower transverse threads to the upper fabric layer by the respective binding transverse thread of a respective functional transverse thread pair extending under at least one lower longitudinal thread during its course in the lower fabric layer within the total repeat (for example exactly one lower longitudinal thread, as shown in FIG. 9). In the total repeat, the functional transverse thread pairs are arranged in groups A to E of respectively two or more functional transverse thread pairs arranged directly one after another in the upper fabric layer when seen in a longitudinal direction (for example arranged in pairs, as shown in FIG. 8), two successive groups A to D respectively being separated from each other by one or two or more upper transverse threads (for example by exactly two upper transverse threads, as shown in FIG. 8).

I.e., as shown in FIG. 8, in the total repeat, in the upper fabric layer, the functional transverse thread pairs may, when seen in a longitudinal direction, for example be arranged in groups A to E of exactly two functional transverse thread pairs ("arrangement in pairs") directly arranged one after another, wherein two successive groups are respectively separated from each other by exactly two upper transverse threads. In other words, one pair of upper transverse threads and one pair of functional transverse thread pairs are alternately arranged one after another in a longitudinal direction in the total repeat on the upper side. The total repeat may include, for example, altogether five groups A to E on the upper side.

As shown in FIG. 9, in the total repeat, the functional transverse thread pairs 104+105, 106+107, etc. may, for example, also be arranged in groups A' to E' of two or more functional transverse thread pairs arranged directly one after another in the lower fabric layer, when seen in a longitudinal direction (for example arranged in pairs, as shown in FIG. 9), wherein respectively one or two or more lower transverse threads are arranged between two successive groups of functional transverse thread pairs (for example exactly two lower transverse threads, as shown in FIG. 9).

I.e., as shown in FIG. 9, in the total repeat, in the lower fabric layer, the functional transverse thread pairs may be arranged, for example, in groups of exactly two directly successive functional transverse thread pairs ("arrangement in pairs"), when seen in a longitudinal direction, two successive groups respectively being separated from each other by exactly two lower transverse threads. The total repeat may, for example, include altogether five groups A' to E' on the lower side.

In other words, in the total repeat, in the lower fabric layer, all binding transverse threads of a respective group of functional transverse thread pairs may bind the lower fabric layer to the upper fabric layer between the same two associated lower transverse threads following one another in a longitudinal direction. For example, the transverse threads 104 to 107 bind between the two lower transverse threads 103 and 108, and the transverse threads 112 to 115 bind between the two lower transverse threads 111 and 116.

As shown in FIG. 9, the interspaces formed between the lower transverse threads may alternately be provided/occupied and not provided/non-occupied with bindings by the binding transverse threads of a respective group of functional transverse thread pairs in the lower fabric layer when seen in a longitudinal direction.

As shown in FIG. 9, each binding transverse thread may extend under/bind another lower longitudinal thread in the lower fabric layer within a respective group of functional transverse thread pairs.

As shown in FIG. 8, the first binding may, for example, be a plain weave which in a longitudinal direction is formed by the upper longitudinal threads and in a transverse direction is formed by the upper transverse threads and the imaginary upper transverse threads formed by the functional transverse thread pairs. A plain weave is particularly advantageous for the paper side and the sheet forming. However, other weaves are also possible for the paper side.

As can be seen in FIG. 9, the second weave may be a 10-shaft weave where the course of the respective lower transverse thread 103, 108, 111, 116, etc. is repeated in a transverse direction after 10 lower longitudinal threads 2, 4, 6, 8, 10, 12, etc. The course of the respective transverse thread is, for example, "above two successive lower longitudinal threads and then under eight successive lower longitudinal threads" (when seen from above; in this respect, one counts "over the edge", i.e. the lower longitudinal thread 2 follows the lower longitudinal thread 20).

As can be seen in FIG. 9, this transverse thread course may extend with a pitch of "three longitudinal threads to the left" bottom-up through the total repeat and the repeat of the lower side, respectively. The lower transverse thread (not shown) of the abutting repeat (abutting on the upper side) following the lower transverse thread 140 then has a course which is identical to that of the lower transverse thread 103.

As can be seen in FIG. 9, exactly two binding transverse threads may extend under each lower longitudinal thread or each lower longitudinal thread may be bound in by exactly two binding transverse threads in the total repeat (and the repeat of the lower side). For example, the lower longitudinal thread 2 is bound-in by the transverse threads 114 and 136. As can be seen in FIG. 9, the binding positions of a respective functional pair may rise with a pitch of "three longitudinal threads to the left" through the total repeat (and the repeat of the lower side).

The screen or rather the fabric according to the first embodiment belongs to the initially described group of transverse thread-bound fabrics, especially to the group of fabrics which are connected by functional transverse thread pairs, which provide a virtually uninterrupted structural upper transverse thread on the upper side, and has the advantage of a reduced number of transverse threads when compared to a transverse thread-bound fabric, in the total repeat of which there are no upper transverse threads on the upper side (but only functional transverse thread pairs).

Moreover, the screen or rather the fabric of the first embodiment has the advantage of a reduced tendency of marking when compared to a transverse thread-bound fabric, in the total repeat of which there are no upper transverse threads on the upper side, since the upper transverse threads bring about a fabric balance (for example, the fabric or rather the upper longitudinal threads are pressed upwards more strongly by the upper transverse threads than by the functional transverse thread pairs which form changeover positions).

Moreover, the screen or rather the fabric of the first embodiment also has the advantage of a reduced tendency to marking when compared to a transverse thread-bound fabric, in the total repeat of which an upper transverse thread and a functional transverse thread pair are alternately arranged on the upper side in a longitudinal direction, since one upper longitudinal thread in two is exclusively supported by functional pairs in the latter. This can be breached/avoided by arranging the functional pairs in pairs with two upper transverse threads arranged therebetween, in which case every upper longitudinal thread is supported by upper transverse threads (at least in portions). Due to the ratio of upper transverse threads to functional pairs of 1:1 on the upper side, a reliable binding of the lower side or rather a stable layer connection can be ensured in addition, i.e. sufficient binding points can be provided for a layer connection. For example, an increase in the number of binding points for a layer connection per fiber support index (FSI according to Beran) can be achieved on the paper side when compared to the state of the art according to FIG. 1.

Figure 11:
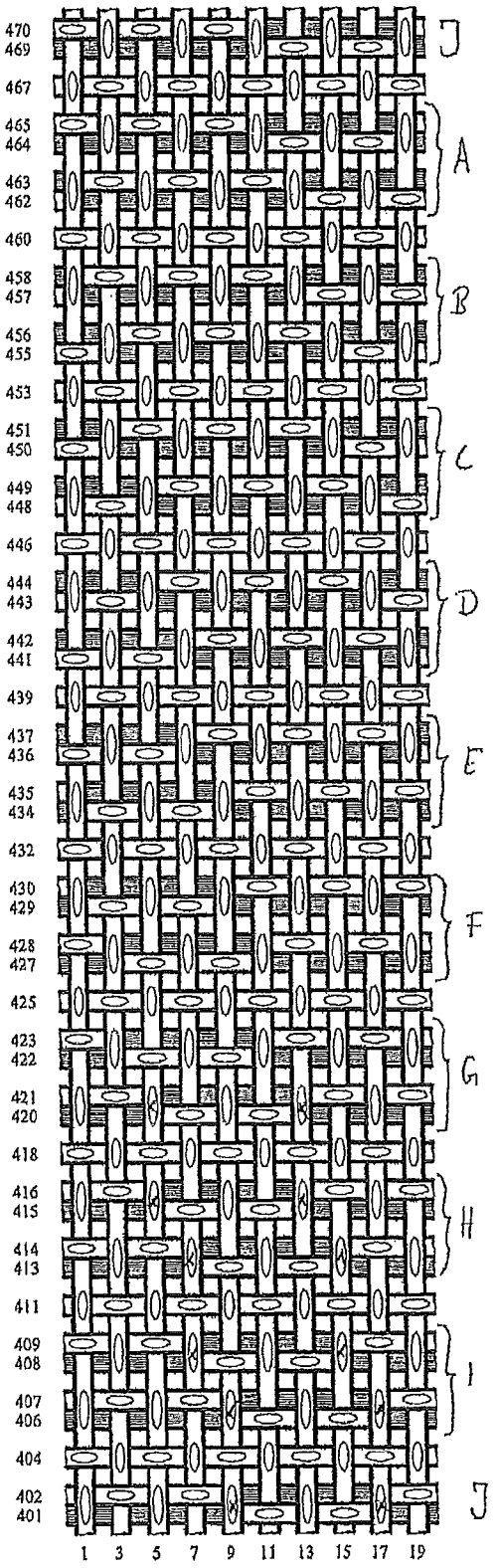
FIG. 11 shows a top view of the upper fabric layer of the total repeat. This corresponds at the same time to a top view of the repeat of the upper fabric layer.
Figure 12:
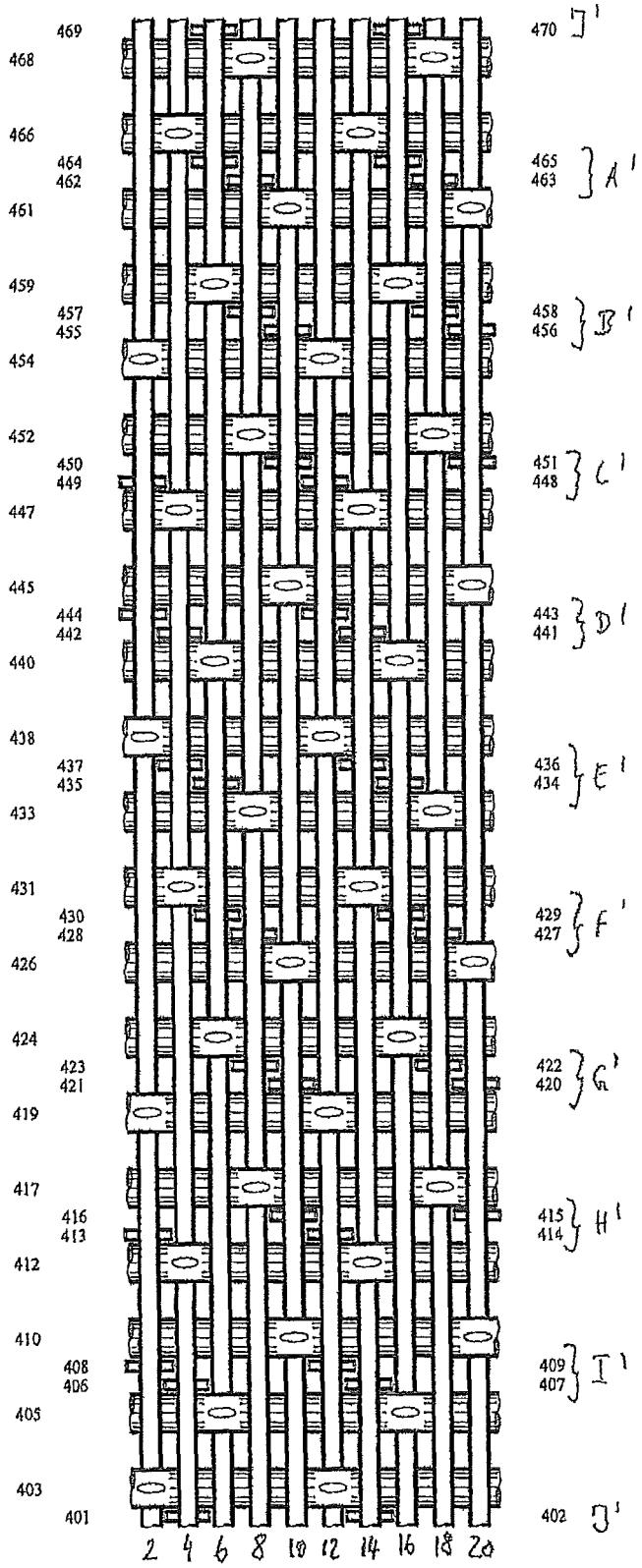
FIG. 12 shows a top view of the lower fabric layer of the total repeat. This corresponds at the same time to a top view of eight weave repeats of the lower fabric layer directly adjacent to each other.

FIGS. 10*a* to 10*d*, 11 and 12 show the total repeat of a multi-layer fabric according to a second embodiment of the invention, serving as a paper machine screen, for example a sheet forming screen, wherein FIGS. 10*a* to 10*d* show the course of the respective transverse thread with respect to lower and upper longitudinal threads in the total repeat, FIG. 11 shows a top view of the upper fabric layer and the upper side of the total repeat, respectively, and wherein FIG. 12 shows a top view of the lower fabric layer of the total repeat. The threads extending from the left-hand side to the right-hand side in the Figures are transverse threads (for example weft threads), and the threads extending bottom-up in the Figures are longitudinal threads or machine direction threads (for example warp threads).

As can be seen in the Figures, analogously to the first embodiment, the multi-layer fabric has an upper fabric layer comprising a first weave (see FIG. 11) and a lower fabric layer comprising a second weave (see FIG. 12). These two fabric layers are interconnected or held together by binding transverse threads (see FIGS. 10*a* to 10*d*), so that the fabric can be referred to as a transverse thread-bound fabric. For example, the upper fabric layer and the lower fabric layer may be interconnected exclusively by the binding transverse threads arranged to form functional transverse thread pairs, i.e., for example, may be free from separate binder threads, in the total repeat, for example in the entire multi-layer fabric.

The multi-layer fabric is formed by (for example exclusively formed by) a total repeat (repeating in the fabric) which includes the following types of threads: upper longitudinal threads 1, 3, 5, 7, 9, etc., which extend exclusively in the upper fabric layer, lower longitudinal threads 2, 4, 6, 8, 10, etc., which extend exclusively in the lower fabric layer, upper transverse threads 404, 411, 418, 425, etc., which extend exclusively in the upper fabric layer and which are interwoven with the upper longitudinal threads, thereby partially forming the first weave, lower transverse threads 403, 405, 410, 412, 417, 419, etc., which extend exclusively in the lower fabric layer and which are interwoven with the lower longitudinal threads, thereby completely forming the second weave, and binding transverse threads 406 to 409, 413 to 416, 420 to 423, 427 to 430, etc., which each extend both in the upper fabric layer and in the lower fabric layer (i.e., these threads change between both fabric layers), and thereby bind the lower fabric layer to the upper fabric layer.

The ratio of upper longitudinal threads to lower longitudinal threads is, analogous to the first embodiment, 1:1. As can be seen in the Figures, the ratio of upper longitudinal threads to lower longitudinal threads may, for example, be 10:10.

The lower longitudinal threads have a diameter that is greater than or equal to the diameter of the upper longitudinal threads. As can be seen in the Figures, upper and lower longitudinal threads may, for example, be equal in diameter. The total repeat and, for example, the entire fabric, may, for example, be free from binding longitudinal threads, i.e. may be formed in the longitudinal direction exclusively by upper and lower longitudinal threads. I.e., in the total repeat, for example in the entire multilayer fabric, all longitudinal threads extending in the upper fabric layer may be upper longitudinal threads, which extend exclusively in the upper fabric layer. Moreover, in the total repeat, for example in the entire multi-layer fabric, all longitudinal threads extending in the lower fabric layer may be lower longitudinal threads, which extend exclusively in the lower fabric layer.

As can be seen in the Figures, the lower transverse threads have a diameter which is greater than the diameter of the upper transverse threads, analogously to the first embodiment. I.e., the lower transverse threads are formed to be thicker than the upper transverse threads. The binding transverse threads are, for example, also formed to be thinner than the lower transverse threads and, in addition, have, for example the same diameter as the upper transverse threads.

The ratio of upper transverse threads to lower transverse threads may, for example, be 1:2, for example 10:20. If one considers the functional transverse thread pairs or the imaginary upper transverse threads formed thereby, the ratio of (upper transverse threads+imaginary upper transverse threads)/lower transverse threads is 3:2, for example 30:20. In this respect, the functional transverse thread pairs are assigned to the upper fabric layer, as they contribute to forming the first weave there, whereas they only serve for binding in the lower fabric layer. Thus, the upper side can be formed to be finer than the relatively coarse lower side.

The ratio of upper transverse threads to functional pairs may, for example, be 1:2, for example 10:20. Hereby, the number of bindings can be increased when compared to the first embodiment as well as to the state of the art according to FIGS. 1 and 2. The upper transverse threads may, for example, be made of polyester, and the binding transverse threads may, for example, be made of polyamide.

As can be seen in particular in FIG. 11, the binding transverse threads form so-called functional transverse thread pairs of respectively two binding transverse threads arranged directly next to each other within the total repeat, analogously to the first embodiment. Both binding transverse threads of a respective functional transverse thread pair alternately complete the first weave, thereby forming an imaginary, uninterrupted upper transverse thread, and, in doing so, respectively extend above one or more upper longitudinal threads. Thereby, so-called changeover or crossing positions are formed underneath an associated longitudinal thread, which in FIG. 11 are partially marked with an "x" and at which one thread of a pair changes to the upper side and the other thread of the pair changes to the lower side. As can be seen in FIG. 11, each functional transverse thread pair may, for example, have/form exactly two changeover positions per total repeat. The changeover positions of all functional pairs may be distributed evenly to the upper longitudinal threads within the total repeat; in this regard, for example, four changeover positions may be allotted to each upper longitudinal thread. The functional pair (not shown) of the next total repeat (in a longitudinal direction above the repeat shown), following the functional pair 469+470, has a course (including the changeover positions) which is identical to that of the functional pair 401+402. Both binding transverse threads of a respective functional transverse thread pair alternately bind the lower fabric layer with the second weave entirely formed by the lower longitudinal threads and the lower transverse threads to the upper fabric layer by the respective binding transverse thread of a respective functional transverse thread pair extending under at least one lower longitudinal thread during its course in the lower fabric layer within the total repeat (for example exactly one lower longitudinal thread, as shown in FIG. 12). In the total repeat, the functional transverse thread pairs are arranged in groups A to J of two or more functional transverse thread pairs arranged directly one after another in the upper fabric layer when seen in a longitudinal direction (for example arranged in pairs, as shown in FIG. 11; in this respect, one counts over the edge with respect to the pair J), wherein two successive groups A to J are respectively separated from each other by one or two or more upper transverse threads (for example by exactly one upper transverse thread, as shown in FIG. 11).

I.e., as shown in FIG. 11, for example the functional transverse thread pairs may be arranged in groups A to J of exactly two functional transverse thread pairs arranged directly one after another in the upper fabric layer when seen in a longitudinal direction in the total repeat ("arrangement in pairs"), two successive groups respectively being separated from each other by exactly one upper transverse thread. In other words, one upper transverse thread and one pair of functional transverse thread pairs are alternately arranged one after another in a longitudinal direction on the upper side in the total repeat. The total repeat may include, for example, altogether ten groups A to J on the upper side.

As shown in FIG. 12, the functional transverse thread pairs in the total repeat may, for example, be arranged in groups A' to J' of two or more functional transverse thread pairs arranged directly one after another also in the lower fabric layer when seen in a longitudinal direction (for example arranged in pairs, as shown in FIG. 12), wherein respectively one or two or more lower transverse threads are arranged between two successive groups of functional transverse thread pairs (for example exactly two lower transverse threads, as shown in FIG. 12).

For example, all binding transverse threads of a respective group of functional transverse thread pairs in the total repeat may bind the lower fabric layer to the upper fabric layer in the lower fabric layer between the same two associated lower transverse threads following one another in the longitudinal direction. For example, the transverse threads 406 to 409 bind between the two lower transverse threads 405 and 410, and the transverse threads 413 to 416 bind between the two lower transverse threads 412 and 417.

As shown in FIG. 12, the interspaces formed between the lower transverse threads in the lower fabric layer, when seen in a longitudinal direction, may alternately be provided/occupied and not be provided/non-occupied with bindings by the binding transverse threads of a respective group of functional transverse thread pairs.

As shown in FIG. 12, each binding transverse thread within a respective group of functional transverse thread pairs may extend under another lower longitudinal thread in the lower fabric layer.

As shown in FIG. 11, the first weave may, for example, be a plain weave which in a longitudinal direction is formed by the upper longitudinal threads and in a transverse direction by the upper transverse threads and the imaginary upper transverse threads formed by the functional transverse thread pairs. However, other weaves are possible for the paper side as well.

As can be seen in FIG. 12, the second weave may be a 5-shaft weave in which the course of the respective lower transverse thread 403, 405, 410, 412, etc. is repeated in a transverse direction after 5 lower longitudinal threads 2, 4, 6, 8, 10, 12, etc. The course of the respective transverse thread is, for example, "over one lower longitudinal thread and then under four successive lower longitudinal threads" (when viewed from above; in this respect, one counts "over the edge", i.e. the lower longitudinal thread 2 follows the lower longitudinal thread 20). As can be seen in FIG. 12, this transverse thread course may extend with a pitch of "two longitudinal threads to the right" bottom-up through the total repeat and the repeat of the lower side, respectively. The lower transverse thread 419 has the same course as the lower transverse thread 419 (and the lower transverse threads 438 and 454). In a transverse direction, the course of the transverse thread 403 is repeated starting from the sixth lower longitudinal thread from the left-hand side (=longitudinal thread 12). Thus, FIG. 12 shows altogether 8 lower weave repeats.

As can be seen in FIG. 12, in the total repeat, each lower longitudinal thread may be bound-in by exactly four binding transverse threads or exactly four binding transverse threads may extend under each lower longitudinal thread. For example, the lower longitudinal thread 2 is bound-in by transverse threads 408, 413, 444 and 449.

Just like the screen of the first embodiment, the screen or fabric of the second embodiment belongs to the initially described group of transverse thread-bound fabrics, especially to the group of fabrics which are connected by functional transverse thread pairs which on the upper side provide a virtually uninterrupted structural upper transverse thread, and, when compared to a transverse thread-bound fabric, in the total repeat of which there are no upper transverse threads on the upper side (but only functional transverse thread pairs), has the advantage of a reduced number of transverse threads. Moreover, the screen or fabric of the second embodiment has the advantage of a reduced tendency to marking, when compared to a transverse thread-bound fabric, in the total repeat of which there are no upper transverse threads on the upper side, as the upper transverse threads bring about a fabric balance. In addition, the screen or fabric according to the second embodiment has the advantage of a reduced tendency to marking also when compared to a transverse thread-bound fabric, in the total repeat of which one upper transverse thread and one functional transverse thread pair are alternately arranged on the upper side in a longitudinal direction, as every second upper longitudinal thread is exclusively supported by functional pairs in the latter. This can be breached/avoided by the arrangement in pairs of the functional pairs with an upper transverse thread arranged therebetween, in which case every upper longitudinal thread is supported (at least in part/in sections) by upper transverse threads. Due to the ratio of upper transverse threads to functional pairs of 1:2 on the upper side, a reliable binding of the lower side and/or a stable layer connection can be ensured in addition, i.e. sufficient binding points can be provided for the layer connection. For example, an increase in the number of binding points for a layer connection per fiber support index (FSI according to Beran) can be achieved on the paper side when compared to the state of the art according to FIGS. 1 and 2.

Hereinafter, calculations regarding the number of binding points for layer connection per fiber support index (FSI according to Beran) on the paper side are provided in the form of a table.

| Parameter | Unit | Prior Art | According to the Invention |
|---|---|---|---|
| Paper side according to . . . | | FIG. 1 | FIG. 3 |
| Warp number in the upper fabric | 1/cm | 33.0 | |
| Warp diameter in the upper fabric | mm | 0.13 | |
| Fiber support relevant weft threads | 1/cm | 36.0 | |
| Physically existing weft threads in the upper fabric | 1/cm | 48.8 | 54.0 |
| Fiber support index (FSI) | 1 | 177.8 | |
| Binding points | $1/cm^2$ | 79.2 | 118.8 |
| Paper side according to . . . | | FIG. 2 | FIG. 6 |
| Warp number in the upper fabric | 1/cm | 33.0 | |
| Warp diameter in the upper fabric | mm | 0.13 | |
| Fiber support relevant weft threads | 1/cm | 36.0 | |
| Physically existing weft threads in the upper fabric | 1/cm | 54.0 | 60.0 |
| Fiber support index (FSI) | 1 | 177.8 | |
| Binding points | $1/cm^2$ | 118.8 | 158.4 |

The invention claimed is:

1. A paper machine screen, formed as a transverse thread-bound multi-layer fabric having an upper fabric layer comprising a first weave and a lower fabric layer comprising a second weave, wherein the multi-layer fabric has a total repeat which includes:

upper longitudinal threads which extend exclusively in the upper fabric layer, lower longitudinal threads which extend exclusively in the lower fabric layer, the ratio of upper longitudinal threads to lower longitudinal threads being 1:1, the lower longitudinal threads having a diameter which is greater than or equal to the diameter of the upper longitudinal threads, upper transverse threads which extend exclusively in the upper fabric layer and which are interwoven with the upper longitudinal threads, thereby partially forming the first weave, lower transverse threads which extend exclusively in the lower fabric layer and are interwoven with the lower longitudinal threads, thereby completely forming the second weave, wherein the lower transverse threads have a diameter which is greater than the diameter of the upper transverse threads, and binding transverse threads which respectively extend both in the upper fabric layer and in the lower fabric layer and hereby bind the lower fabric layer to the upper fabric layer, wherein, within the total repeat, the binding transverse threads form functional transverse thread pairs of respectively two binding transverse threads arranged directly next to each other, wherein the two binding transverse threads of a respective functional transverse thread pair alternately complete the first weave and, in doing so, respectively extend over one or more upper longitudinal threads, thereby forming an imaginary upper transverse thread, wherein the two binding transverse threads of a respective functional transverse thread pair alternately bind the lower fabric layer with the second weave completely formed by the lower longitudinal threads and the lower transverse threads to the upper fabric layer by the respective binding transverse thread of a respective functional transverse thread pair extending under at least one lower longitudinal thread during its course in the lower fabric layer within the total repeat, and wherein, in the total repeat, the functional transverse thread pairs in the upper fabric layer are arranged in groups of respectively two or more functional transverse thread pairs arranged directly one after another, when seen in a longitudinal direction, wherein two successive groups are respectively separated from each other by one or two or more upper transverse threads.

2. The paper machine screen according to claim 1, wherein, in the total repeat, the functional transverse thread pairs in the upper fabric layer are arranged in groups of exactly two functional transverse thread pairs arranged directly one after another, when seen in a longitudinal direction, and/or in the total repeat in the upper fabric layer two directly successive groups are respectively separated from each other by exactly one or respectively by exactly two upper transverse threads.

3. The paper machine screen according to claim 1, wherein, in the total repeat, the functional transverse thread pairs are, also in the lower fabric layer, arranged in groups of two or more functional transverse thread pairs arranged directly one after another when seen in a longitudinal direction, wherein respectively one or two or more lower transverse threads are arranged between two successive groups of functional thread pairs.

4. The paper machine screen according to claim 3, wherein, in the total repeat, the functional transverse thread pairs are arranged in groups of exactly two functional transverse thread pairs arranged directly one after another in the lower fabric layer when seen in a longitudinal direction, and/or in the total repeat in the lower fabric layer two successive groups are respectively separated from each other by exactly two lower transverse threads.

5. The paper machine screen according to claim 1, wherein, in the total repeat, in the lower fabric layer all binding transverse threads of a respective group of functional transverse thread pairs bind the lower fabric layer to the upper fabric layer between the same two associated lower transverse threads following one another in a longitudinal direction.

6. The paper machine screen according to claim 1, wherein, in the lower fabric layer, the interspaces formed between the lower transverse threads are alternately provided and not provided with bindings by the binding transverse threads of a respective group of functional transverse thread pairs, when seen in a longitudinal direction.

7. The paper machine screen according to claim 1, wherein the first weave is a plain weave which in the longitudinal direction is formed by the upper longitudinal threads and in the transverse direction is formed by the upper transverse threads and the imaginary upper transverse threads formed by the functional transverse thread pairs.

8. The paper machine screen according to claim 1, wherein the total repeat and/or the repeat of the upper fabric layer includes 8, 10 or 12 upper longitudinal threads.

9. The paper machine screen according to claim 1, wherein the second weave is a 5-shaft weave or a 10-shaft weave in which the course of the respective lower transverse thread is repeated in a transverse direction after 5 and 10 lower longitudinal threads, respectively.

10. The paper machine screen according to claim 1, wherein the total repeat includes:

10 upper longitudinal threads,
10 lower longitudinal threads,
10 upper transverse threads,
10 lower transverse threads, and
20 binding transverse threads which form 10 functional transverse thread pairs.

11. The paper machine screen according to claim 1, wherein the total repeat includes:

10 upper longitudinal threads,
10 lower longitudinal threads,
10 upper transverse threads,
20 lower transverse threads, and
40 binding transverse threads which form 20 functional transverse thread pairs.

12. The paper machine screen according to claim 1, wherein, in the total repeat all longitudinal threads extending in the upper fabric layer are upper longitudinal threads which extend exclusively in the upper fabric layer, and/or
in the total repeat all longitudinal threads extending in the lower fabric layer are lower longitudinal threads which extend exclusively in the lower fabric layer, and/or
in the total repeat the upper fabric layer and the lower fabric layer are connected to each other exclusively by the binding transverse threads arranged to form functional transverse thread pairs.

13. The paper machine screen according to claim 1, wherein the upper transverse threads are made of polyester and the binding transverse threads are made of polyamide.

14. The paper machine screen according to claim 1, wherein the binding transverse threads are smaller in diameter than the lower transverse threads.

15. The paper machine screen according to claim 1, wherein, in the upper fabric layer, the total repeat comprises five groups or ten groups of functional pairs.

16. The paper machine screen according to claim 1, wherein, in the total repeat, the ratio of upper transverse threads, including functional transverse thread pairs, to lower transverse threads is greater than 1.

17. The paper machine screen according to claim 1, wherein, in the total repeat, each functional transverse thread pair forms exactly two intersections and/or wherein the intersections of all functional transverse thread pairs are distributed evenly to the upper longitudinal threads within the total repeat, so that the same number of intersections is positioned under each upper longitudinal thread.

* * * * *